US005512357A

United States Patent [19]

Shimura et al.

[11] Patent Number: 5,512,357

[45] Date of Patent: Apr. 30, 1996

[54] POLYPROPYLENE FLEXIFILAMENTARY FIBER CONTAINING 0.1 TO 10 WEIGHT PERCENT OF AN ORGANIC SPREADING AGENT AND NONWOVEN FABRIC MADE THEREFROM

[75] Inventors: Kazuhiko Shimura; Yoshiaki Nakayama, both of Moriyama, Japan

[73] Assignee: Asahi Kasei Kogyo Kabushiki Kaisha, Osaka, Japan

[21] Appl. No.: 43,973

[22] Filed: Apr. 7, 1993

Related U.S. Application Data

[63] Continuation of Ser. No. 921,392, Jul. 30, 1992, abandoned, which is a continuation of Ser. No. 785,903, Nov. 4, 1991, abandoned, which is a continuation of Ser. No. 362,462, filed as PCT/JP87/00808, Oct. 22, 1987, abandoned.

[30] Foreign Application Priority Data

| | | | |
|---|---|---|---|
| Jun. 20, 1987 | [JP] | Japan | 62-152416 |
| Jun. 26, 1987 | [JP] | Japan | 62-157773 |
| Jul. 18, 1987 | [JP] | Japan | 62-178179 |
| Aug. 3, 1987 | [JP] | Japan | 62-192598 |
| Aug. 12, 1987 | [JP] | Japan | 62-199978 |

[51] Int. Cl.[6] ..... B32B 5/16; D04H 1/58; D02G 3/00

[52] U.S. Cl. ..... 428/283; 428/288; 428/370; 428/372

[58] Field of Search ..... 428/283, 288, 428/370, 372

[56] References Cited

U.S. PATENT DOCUMENTS

| | | | |
|---|---|---|---|
| 3,081,519 | 1/1962 | Blades et al. | 428/338 |
| 3,169,899 | 2/1965 | Steuber | 428/156 |
| 3,564,088 | 9/1969 | Woodell | 264/53 |
| 3,655,498 | 4/1972 | Woodell | 428/369 |
| 3,686,848 | 8/1972 | Miller et al. | 57/140 R |
| 3,756,441 | 9/1973 | Anderson et al. | 264/205 |
| 3,900,631 | 8/1975 | Woodell | 428/195 |
| 4,166,091 | 8/1979 | Beebe | 264/205 |

*Primary Examiner*—James D. Withers
*Attorney, Agent, or Firm*—Finnegan, Henderson Farabow, Garrett & Dunner

[57] ABSTRACT

The present invention relates to a polypropylene three-dimensional plexifilamentary fiber, a method of manufacturing same, and a nonwoven fabric composed of the above fiber.

The plexifilamentary fiber in accordance with the present invention has a three-dimensional plexifilamentary structure, and is characterized in that the fiber has a microwave birefringence of 0.07 or more. As a result, a dimensional stability under heating of the plexifilamentary fiber in accordance with the present invention is extremely high. Moreover, it is possible to obtain a plexifilamentary fiber having a high spreadability by adding a spreading agent to the plexifilamentary fiber. A nonwoven fabric made of such plexifilamentary fiber has a high thermal dimensional stability, and as a result, the nonwoven fabric in accordance with the present can be usefully used in a wrapping material having a heat resistance and air permeability, apparel having heat resistance and moisture permeability, a heat resistance paper, and engineering and building materials or the like.

7 Claims, 6 Drawing Sheets

POLYPROPYLENE FLEXIFILAMENTARY FIBER CONTAINING 0.1 TO 10 WEIGHT PERCENT OF AN ORGANIC SPREADING AGENT AND NONWOVEN FABRIC MADE THEREFROM

This application is a continuation of aplication Ser. No. 07/921,392 filed Jul. 30, 1992, now abandoned, which is a continuation of aplication Ser. No. 07/785,903 filed on Nov. 4, 1991, now abandoned, which is a continuation of application Ser. No. 07/362,462 filed as PCT/JP87/00808, Oct. 22, 1987, now abandoned.

TECHNICAL FIELD

The present invention relates to a highly fibrillated three-dimensional plexifilamentary fiber of a polypropylene, methods of manufacturing same, and a nonwoven fabric manufactured by the highly fibrillated three-dimensional plexifilamentary fibers. In particular, the present invention relates to a three-dimensional plexifilamentary fiber made of a polypropylene and having a high heating dimensional stability; a three-dimensional plexifilamentary fiber made of the polypropylene and having a high fiber spreadability and a high dimensional stability under heating; methods of manufacturing those three-dimensional plexifilamentary fibers; and a nonwoven fabric composed of those fibers and having a high dimensional stability under heating.

Since the present application includes various related inventions as described herebefore, the inventions are divided by labelling them A, B, C and D, described as follows, for convenience of the explanation and an easy understanding, and these labels are applied at the beginning of the corresponding descriptions in the following text, respectively.

A A novel polypropylene three-dimensional plexifilamentary fiber.

B A novel polypropylene highly spread three-dimensional plexifilamentary fiber.

C A novel manufacturing method of the polypropylene three-dimensional plexifilamentary fiber.

D A novel nonwoven fabric composed of the polypropylene three-dimensional plexifilamentary fiber.

PRIOR ART

A A fiber manufactured by a flash spinning technique is known as a fiber fibrillated in a three-dimensional plexifilamentary state. The flash spinning technique is a spinning method in which an uniform solution of a polymer having a fiber-forming ability and a solvent is instantaneously extruded through a spinneret having holes of one or more from a condition at a temperature higher than a boiling temperature of the solvent and under a pressure higher than a vapor pressure of the solvent to an area under a lower pressure. The features of the fiber are disclosed in U.S. Pat. No. 3,081,519.

Namely, the fiber disclosed in U.S. Pat. No. 3,081,519 is a fiber of an organic synthetic crystalline polymer having a surface area of 2 $m^2/g$ or more and a structure in which fibrils are spread in a three-dimensional plexifilamentary state. The fibril has a average thickness of 4μ or less and an orientated structure, and is characterized in that an average orientation angle measured by an electron diffraction method is 90° or less. Further this fiber is characterized in that an average orientation angle measured by a X-ray diffraction method is smaller than 55°, and a number of free fibrils is 50/1000 d/0.1 mm or 25/1000 d/0.1 mm, or the like. This three-dimensional plexifilamentary fiber has a non-circular cross section, and a large specific surface area, an excellent light scattering property, a required bulkiness and a high strength. Therefore, it is possible to make a nonwoven fabric having a high covering property and a high strength by utilizing the shape and characteristics of this fiber. A nonwoven fabric manufactured from a linear polyethylene fiber having a trade name of Tyvek, and supplied from E. I. Dupont Numeraus Co., has been commercially supplied as an example of the above nonwoven fabric.

It is possible to use a polypropylene (referred to as PP hereinafter) having a melting point higher than that of the linear polyethylene by 25° C. to 35° C. as a material capable of satisfying a need for a higher thermal resistance than that of the linear polypropylene. A problem of the known three-dimensional plexifilamentary fiber manufactured from PP is that the thermal stability, i.e., a dimensional stability under a heat atmosphere, is low. Namely, extension or shrinkage under heat is very large.

Further, U.S. Pat. No. 3,081,519 disclosed that the existence of an orientation of a crystal and degree of orientation thereof are confirmed by measuring an orientation angle by an electron diffraction and X-ray diffraction with regard to a molecular orientation in a fibril and a fiber. This publication, however, does not disclose a fine structure influencing the dimensional stability under heating, i.e., the extension or the shrinkage under heat in the three-dimensional plexifilamentary fiber.

B One disadvantage of the PP fiber is that PP fiber is not easily spread. This property is inferior to that of the high-density polyethylene. The fiber spreading described in this specification means that a fiber extruded from a single spinnerate is split into finer elements, for example, to cause each fiber (referred to a fibril hereinafter) to constitute a net-like structure.

It is possible to elevate a degree by which the fiber is spread, i.e., fiber spreading degree, by a number of free fibrils and a width of the fiber. The number of free fibrils is a measure expressing a degree by which the fiber is split into finer elements, and is expressed by a number of the split fiber per unit weight of the fiber. When the number of free fibrils is large, the fiber is finely split. The width of fiber is an extent in a direction perpendicular to a fiber axis of the fiber when the fiber extruded from the single spinneret is spread in a direction of the fiber axis and the direction perpendicular to the fiber axis. Since the width of fiber is proportional to a quantity of the fiber, the width of the fiber is expressed as the extent of fiber per unit weight of the fiber, e.g., 20 mm/200 d.

It is possible to generally determine the fiber spreading degree by the fiber width, except where the number of free fibrils is small, the fibrils are collected, or split spacing occurs in the fiber, so that holes are generated in the spread fiber.

If the fiber is extruded when the number of free fibrils is not small and the split spacing, holes or the like are not generation in the fiber, by a spinnerate having a single nozzle and having no groove in an outside thereof or a circular groove when the groove is arranged on the outside thereof, the maximum fiber width is about 15 mm for a fiber of 150 d. Therefore, it is impossible to close the spaces between fibers by overlaying with fibers. If it is intended to close the spaces, only a nonwoven fabric having many the fibers and a thick thickness can be obtained, and such a nonwoven fabric has an inferior uniformity of weight per unit area and appearance. To obtain a nonwoven fabric having a small weight per unit area and superior uniformity of weight per unit area and the appearance, the width of the fiber must be 20 mm or more, preferably 40 mm or more, regardless of the quantity of the fibers.

The fiber used for the nonwoven fabric must have a good fiber spreading degree, as described hereinbefore. A method of spreading the fiber by striking a polymer stream extruded from a spinneret on an impingement plate is disclosed in Example 9 of U.S. Pat. No. 3,169,899, but a tensile strength of the fiber obtained by this method is 0.53 g/d, and this strength is unsatisfactory, and thus it was difficult to make a fiber having a high strength and large width from polypropylene. To solve this problem, a method for widening the width of fiber by modifying a shape of the spinneret, for example, applying rectangular grooves to the spinneret was proposed, as described in U.S. Pat. Nos. 3,467,744, 564,088 and 3,756,441. Although a fiber having a broad width was obtained by the above method, since the flashing power was not effectively operated under a spinning condition or shape of the spinneret, orientation of the obtained fiber was low, and the dimensional stability under heating also was low.

C A conventional method of manufacturing a PP three dimensional plexifilamentary fiber will be now explained.

A method of flash-spinning by using a trichlorofluoromethane (referred to as R-11, hereinafter) as a solvent is disclosed in U.S. Pat. No. 3,564,088 and No. 3,756,441, and Japanese Unexamined Patent Publication (Kokai) No. 62-33816, the applicant for which being the same as that for the present application.

In a process disclosed in the U.S. Pat. No. 3,564,088 and obtaining a fiber-aggregating web in which fibers are associated in one body by using a spinneret having a plurality of spinning holes, a method of manufacturing a plexifilamentary fiber of an isotactic polypropylene (referred to as i-pp, hereinafter) uses the following steps.

a A uniform and pure solution of 4% to 20% of i-pp having MFR of between 0.09 and 10 was prepared by a solvent of a fluoride chloride carbon hydride group selected from 1,1,2-trichlor-1,2,2-trifluoroethane (referred to as R-113, hereinafter), a R-11 and a mixture thereof, and having a critical temperature between 190° C. and 220° C., and this solution was applied at a temperature higher than a critical temperature of a component having a lowest boiling temperature among the above solvents and a pressure higher than a boundary pressure in a two-liquid-phase.

b The solution was then passed to a pressure let-down zone, to decrease a pressure of the solution to a pressure below 10 psi to 400 psi from the two-liquid-phase boundary pressure.

c The solution was passed through a spinning orifice, exhausted to an environment having substantially atmospheric pressure and temperature, and a highly fibrillated continuous fiber was obtained.

A dimensional stability under heating of pp plexifilamentary fiber obtained by the above method was still unsatisfactory. Especially, when a continuous spinning method in which a pp resin was melted and dissolved into the solvent by a screw-extruder was used, it was impossible to stably obtain a fiber having a high dimensional stability under heating on the basis of the conditions described in the U.S. Pat. No. 3,564,088, due to a low solubility of the pp resin caused by a short detention time of the solution in a solution forming zone.

U.S. Pat. 3,756,441 discloses a method of manufacturing a filament-like material of i-pp by heating the i-pp of 2 wt % to 20 wt % in a solvent under a vapor pressure thereof to make a solution, and extruding the solution to a zone having a lower temperature and a lower pressure, and this method is characterized in that a temperature between 200° C. and 240° C. and a pressure of 63.3 kg/cm$^2$ or more are used, a melting flow rate (referred to as MFR in this specification) of i-pp just before the extrusion satisfied the following equation, and the MFR is between 2 and 30.

$$\frac{MFR}{C} \geqq 1.13 - 0.04\,(T - 220)$$

Wherein C is a concentration of i-pp expressed by wt %, and T is a solution temperature expressed in centigrade.

The three-dimensional plexifilamentary fiber obtained by this method also has an unsatisfactory dimension stability under heating. Further, when this fiber was spread by striking, the fiber was apt to split in a direction of the fiber axis, so that holes were made in the spread fiber, and in an extreme case the fiber was broken. Further, since a relatively high temperature of the solution was used, a disadvantage is incurred in that the fiber is likely to be colored.

The method disclosed in Japanese Unexamined Patent Publication (Kokai) No. 62-33816 is characterized in that a solution of i-pp is flash-spun by passing the solution through a final nozzle having a diameter of between 0.75 mm and 1.5 mm at a spinning temperature under a critical temperature of the solvent, for example, at a spinning temperature under 198° C., when using R-11 as the solvent and the MFR of the polymer just before the extrusion is 15 or less.

The disadvantages of this method are that flashing power is low, because the temperature of the solution is under the critical temperature of the solvent, i.e., is a low temperature, and that a pressure in a pressure let-down chamber become unavoidably low when preferably making the pressure in the pressure let-down chamber a pressure of a two-liquid-phase boundary pressure or less. Therefore, an orientation of the spun fiber is low and a dimensional stability under heating, especially a stability for an extension under heating was unsatisfactory. Further, a fiber spreading property is inferior due to the low temperature of the solution.

Further methods using R-113 as the solvent are disclosed in U.S. Pat. No. 3,564,088 and No. 3,467,744, and Japanese Unexamined Patent Publication (Kokai) No. 62-33816, and a dimensional stability under heating of pp three-dimensional flexifilamentary fiber manufactured by this method is almost the same as that of the fiber manufactured by the method disclosed in the U.S. Pat. No. 3,756,441 and has an inferior fiber spreading property.

D A nonwoven fabric composed of conventional three-dimensional plexifilamentary fibers will be described hereinafter.

A nonwoven fabric composed of fibers fibrillated in a three-dimensional plexifilamentary state is known. In particular, a nonwoven fabric composed of fibers manufactured by a flash spinning method is disclosed in U.S. Pat. No. 3,169,899 or Japanese Examined Patent Publication (Kokoku) No. 36-16460.

Those nonwoven fabrics have several features as described hereinbefore and, for example, a nonwoven fabric composed of linear polyethylene is already sold on a commercial scale.

A concrete example of the nonwoven fabric composed of pp three-dimensional plexifilamentary fibers was disclosed in U.S. Pat. No. 3,169,899 as an example 9. In this example, a tensile strength of a nonwoven fabric in which the fibers were bonded by contact with each other before a heat-bonding treatment was 0.24 kg/3 cm width/50 g/m$^2$ or more, and a yarn picked up from a sheet of this nonwoven fabric had a tensile strength of 0.53 g/d and a X-ray orientation angle of 50°. It is possible to estimate that a heat-bonded nonwoven fabric obtained from this contact-bonding nonwoven fabric has a high elongation i.e., a low dimensional stability under heating, from values of the strength and the X-ray orientation angle of the yarn in the nonwoven fabric before the heat-bonding treatment.

In the pp three-dimensional flexifilamentary fiber disclosed in the U.S. Pat. No. 3,169,899, a spread yarn is obtained by a method in which a fiber extruded from a spinneret strikes against an impingement plate or the like as described in item B, but it is impossible to obtain a spread yarn having a high strength, i.e., a high orientation. Namely, the strength of the spread yarn is reduced due to a splitting of the yarn, upon applying a spreading by striking against an impingement plate or the like and is likely to cause a reduction of the strength and an inferior appearance of a nonwoven fabric made of this spread yarn.

In an extreme case, a fiber is broken to make a fiber having a short length, and a piled sheet cannot be obtained due to a scattered state of the fiber. As a result of a greater consideration of the strength, i.e., the orientation in a direction of an axis of the fiber, and reducing a dispersion of a flashing force toward a transverse direction of the fiber, upon obtaining a spread yarn having a relatively high strength, only a fiber having a low spreadability can be obtained. In this case a nonwoven fabric having an inferior uniformity of the orientation in a plane and an appearance such as a thickness, weight per unit area, a whiteness, an opacity or the like can be obtained.

As described herebefore, the spreadability is important as a fiber used in a nonwoven fabric, and it is extremely important to uniformly disperse the spread fiber in the plane to obtain a nonwoven fabric having the uniform appearance such as the thickness and the weight per unit area. To solve this problem, it is important to strike a stream of a polymer solution extruded from a spinneret on a rotating or vibrating impingement plate. Nevertheless, as described in herebefore, sometimes a yarn having a high strength or a highly spread yarn can not be obtained. To solve this problem, a proposal to obtain a broad fiber such as a fiber widen by just a strike by modifying a shape of the spinneret, for example, applying rectangle grooves to the spinneret is disclosed in U.S. Pat. No. 3,467,744, No. 3,564,088 or No. 3,756,441 (see the explanation in term B). Although a fiber having a strength of up to about 3 g/d and a broad width can be obtained by using a fiber twisted by about 4 twist per cm, the fiber obtained by this method is apt to split upon striking an impingement plate during a dispersion treatment to make an uniform plied body and an appearance of a nonwoven fabric made of this fiber is likely to become irregular, and if a weak striking force is used, the dispersion ability becomes low and the appearance of the nonwoven fabric becomes irregular.

Where a plurality of nozzles are arranged in a plane in a spinneret as disclosed in U.S. Pat. No. 3,564,088, a boundary area where the spread yarn extruded different nozzles are piled on each other, become a thick film and only a nonwoven fabric including stripes in a running direction of the nonwoven fabric and having an irregular thickness and appearance can be obtained.

As described hereinbefore, the conventional known and highly fibrillated polypropylene three-dimensional plexifilamentary fiber, the manufacturing methods thereof and the nonwoven fabric manufactured by the fiber have various problems on disadvantages. Those problems are described as follows.

A dimensional stability in a heated environment of a conventional known three-dimensional plexifilamentary fiber is low. When the fiber or a web manufactured by piling the fibers is applied with a heat treatment such a heat setting or a heat-bonding, the fiber or the web is likely to be deformed and to be shrunk by heat.

B Further, there was a pp three-dimensional plexifilamentary fiber having superior dimensional stability under heating and superior spreadability herebefore.

C It is difficult to stably spin a pp three-dimensional plexifilamentary fiber by a screw type extruder by using a conventional known manufacturing method. If the fiber is spun from a solution having a low viscosity under a relatively low temperature, a spread yarn having a superior configuration cannot be obtained. If the fiber is spun from the solution under the relatively high temperature, a fiber is likely to be colored. If the fiber is spun from the solution under a relatively low temperature, a fiber having a high orientation and a good configuration cannot be obtained.

D Therefore, a nonwoven fabric composed of a pp three-dimensional plexifilamentary fiber and having a high dimensional stability under heating, and superior uniformity of the dimensional stability under heating, an orientation in a plane, a thickness, a weight per unit area and an appearance such as a whiteness, an opacity or the like could not be obtained hereinbefore. Especially, it is difficult to make a nonwoven fabric having a small weight per unit area and uniform thickness, weight per unit area and appearance by the conventional technique.

DISCLOSURE OF THE INVENTION

The present invention aims to provide a novel polypropylene three-dimensional plexifilamentary fiber, methods of manufacturing same, and a novel nonwoven fabric composed of the above fiber. In particular, a primary object of the present invention is to provide a fiber having an extremely high dimensional stability under heating and a three-dimensional plexifilamentary configuration (A).

A second object of the present invention is to provide a fiber having an extremely high dimensional stability under heating and a high spreadability and the three-dimensional plexifilamentary configuration (B).

A third object of the present invention is to provide a method of manufacturing the three-dimensional plexifilamentary fiber using a flash spinning method in which a special phase equilibrium of a polypropylene and a solution having a high viscosity are used (C).

A fourth object of the present invention is to provide a nonwoven fabric manufactured of the fibers belonging to the above (A) and (B), which nonwoven fabric has a high dimensional stability under heating (D).

The primary object of the present invention is attained by a fibrillated polypropylene three-dimensional plexifilamentary fiber characterized in that a microwave birefringence of said three-dimensional plexifilamentary fiber is 0.07 or more.

The second object of the present invention is attained by a fibrillated polypropylene three-dimensional plexifilamentary fiber characterized in that said three-dimensional plexifilamentary fiber includes a spreading agent of 0.1 wt % to 10 wt %.

The third object of the present invention is attained by a method of manufacturing a fibrillated polypropylene three-dimensional plexifilamentary fiber manufactured by extruding a uniform solution composed of an isotactic polypropylene and a trichlorofluoromethane under a high pressure through a pressure let-down chamber and a spinneret into a low-pressure low-temperature zone, characterized in that a pressure of the solution just before the solution passes through the pressure let-down chamber is an extinction initiation pressure or more, a temperature in the pressure let-down chamber is 198° or more and less than 220° C., a pressure in the pressure let-down chamber is an extinction termination pressure or less and a melting flow rate (MFR) of the isotactic polypropylene just before the extrusion satisfies the following requirement:

$$0.15 - 0.0014\,(T_{PF} - 198) \leqq \frac{MFR}{C} \leqq 1.74 - 0.029\,(T_{PF} - 198)$$

Wherein $T_{PF}$ stands for a solution temperature in the pressure let-down chamber expressed by °C., just before the extrusion, and C stands for a concentration of the polypropylene, expressed by wt %.

The fourth object of the present invention is attained by a nonwoven fabric composed of a fibrillated polypropylene three-dimensional plexifilamentary fiber characterized in that a microwave birefringence in a cross section of the nonwoven fabric is 0.06 or more.

BEST MODE OF CARRYING OUT THE INVENTION

Figure 1:
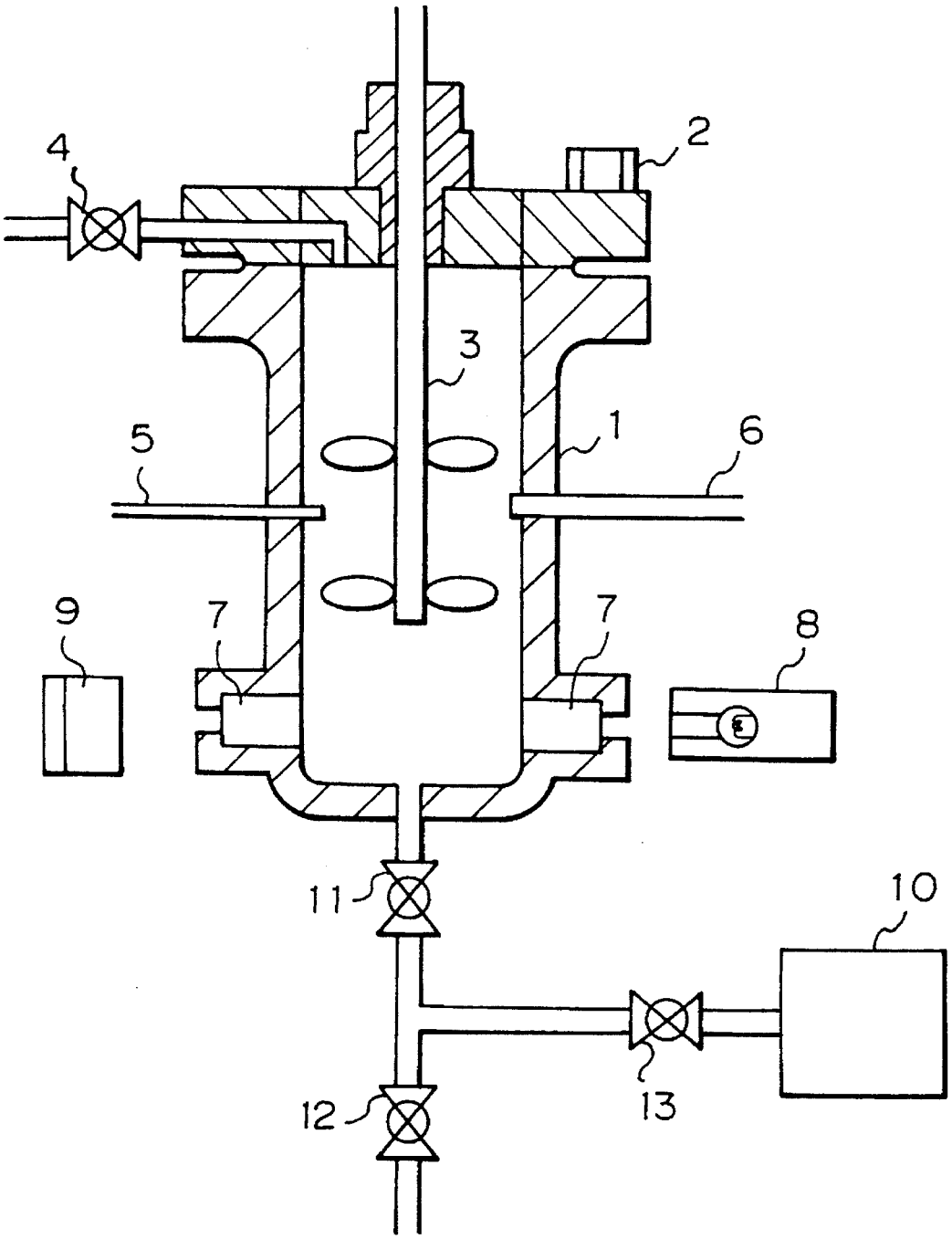
FIG. 1 is a schematic view of an apparatus for measuring an extinction termination temperature and a pressure thereof, and an extinction initiation temperature and a pressure thereof of a raw polymer of a fiber.

The present invention will be described in detail hereinafter with reference to the accompanying drawings, which are used for explaining a polypropylene plexifilamentary fiber, a method of manufacturing same, and a nonwoven fabric manufactured from the plexifilamentary fiber.

A A polypropylene fibrillated fiber belonging to the classification A in accordance with the present invention is characterized in that a fiber has a three-dimensional plexifilamentary structure and a microwave birefringence of 0.07 or more.

The inventors found that, when the pp three-dimensional plexifilamentary fiber is a fiber having the microwave birefringence of 0.07 or more, a dimensional stability under heating of the fiber is superior, especially an elongation stability under heating is superior, and a problem caused by a change of the dimension upon applying a heat treatment is eliminated, and further, when the plexifilamentary fiber is a fiber having a long period scattering intensity ratio of 10 or more, a thermal shrinkage of the fiber is low and a problem caused by shrinkage appearing upon applying the heat treatment is eliminated, and the present invention is accomplished.

The pp three-dimensional plexifilamentary fiber in accordance with the present invention and having the microwave birefringence of 0.07 or more has an elongation under heating of about 8% or less at 100° C. and about 12% or less at 130° C. The pp three-dimensional plexifilamentary fiber in accordance with the present invention having the microwave birefringence of 0.10 or more has the elongation under heating of about 4% or less at 100° C. and about 6% or less at 130° C. The plexifilamentary fiber in accordance with the present invention and having the microwave birefringence of 0.07 or more and a long period scattering intensity ratio of 10 or more has an elongation under heating of about 8% or less at 100° C. and about 12% or less at 130° C., and a thermal shrinkage of about 11% or less. The plexifilamentary fiber in accordance with the present invention and having the microwave birefringence of 0.07 or more and a long period scattering intensity ratio of 10 or more has an elongation under heating of about 4% or less at 100° C. and about 6% or less at 130° C., and a thermal shrinkage of about 11% or less. The plexifilamentary fiber in accordance with the present invention and having the microwave birefringence of 0.07 or more and a long period scattering intensity ratio of 30 or more has an elongation under heating of about 8% or less at 100° C. and about 12% or less at 130° C., and a thermal shrinkage of about 6% or less. The plexifilamentary fiber in accordance with the present invention and having the microwave birefringence of 0.10 or more and a long period scattering intensity ratio of 30 or more has an elongation under heating of about 4% or less at 100° C. and about 6% or less at 130° C., and a thermal shrinkage of about 6% or less.

B A polypropylene fibrillated fiber belonging to the classification B in accordance with the present invention is characterized in that a fiber having a three-dimensional plexifilamentary structure includes a spreading agent of 0.1 wt % to 10 wt %, and thus the three-dimensional plexifilamentary fiber having an improved spreadability and an extremely good configuration can be obtained by including the spreading agent.

The pp three-dimensional plexifilamentary fiber including the spreading agent of 0.1 wt % to 10 wt % can attain a high spreading having a number of free fibrils of 200/50 d or more and a fiber width 20 mm/100 d or more by a spreading operation. When those fibers are piled and heat-bonded, a nonwoven fabric having a high utility is obtained.

The three-dimensional plexifilamentary fiber having a high spreadability and a microwave birefringence of 0.07 or more has an elongation under heating of about 8% or less at 100° C. and about 12% at 130° C. Further, the plexifilamentary fiber having a microwave birefringence of 0.10 or more has an elongation under heating of about 4% or less at 100° C. and about 6% or less at 130° C. The plexifilamentary fiber in accordance with the present invention and having high spreadability, a microwave birefringence of 0.07 or more and a long period scattering intensity ratio of 5 or more has an elongation under heating of about 8% or less at 100° C. and about 12% or less at 130° C., and a thermal shrinkage of about 11% or less. Further, the plexifilamentary fiber in accordance with the present invention and having the high spreadability, the microwave birefringence of 0.10 or more and the long period scattering intensity ratio of 5 or more has an elongation under heating of about 4% or less at 100° C. and about 6% or less at 130° C., and a thermal shrinkage of about 11% or less. The plexifilamentary fiber in accordance with the present invention and having the high spreadability, the microwave birefringence of 0.07 or more and the long period scattering intensity ratio of 15 or more has an elongation under heating of about 8% or less at 100° C. and about 12% or less at 130° C., and a thermal shrinkage of about 6% or less. Further the plexifilamentary fiber in accordance with the present invention and having the high spreadability the micro birefringence of 0.10 or more and the long period scattering intensity ratio of 15 or more has an elongation under heating of about 4% or less at 100° C. and about 6% or less, and a thermal shrinkage of about 6% or less The spread yarn in accordance with the present invention obtained by adding the spreading agent to the fiber has a feature that the thermal shrinkage is very low compared with that of the fiber excluding the spreading agent, even if each value of the long period scattering intensity ratio is the same.

The spreading agent means a material capable of generating a spreading effect by blending to a PP solution before an extrusion thereof and striking a high speed fiber stream extruded from a spinneret against an impingement plate.

If a number of free fibrils are about 150/50 d or more and a fiber width of 20 mm/100 d or more, it is defined that a spreading effect appears. At the time of measuring the fiber width, when the fibril is not found in an area over 50% of the obtained fiber width, i.e., a split or hole is found in the area, the spreadability of this fiber is defined as inferior due to the presence of splits or holes.

The number of free fibrils is determined by counting the number of separate fibrils by using a microscope with an object lens of 1.6 magnifications and an eyepiece of 10 magnifications and moving a visual field in the transverse direction of the fiber. If the magnification of the microscope is raised, the number of free fibrils is increased.

The fiber width was measured by receiving the fiber in the spread state after the spreading operation on a net of a coarse mesh size (about 10 mesh). In the case where the fiber is not received on the net, the fiber having a length of 120 mm or more is laid down, one side end is fixed to a vertical plate by a pin, seven weights having a load largest within the range not breaking the plexifilamentary structure of the fiber (about 0.1 g) are hung down at intervals of 20 mm on the other side end, the fiber width is measured at five points except both the ends, and the mean value is calculated. The so-determined fiber width is not different from the value measured by receiving the spread fiber on the net.

The measurement of a content of the spreading agent is preformed by a suitable means depending with a kind of the spreading agent used. For example, for a spreading agent including a definite composition of a specific metal element, a quantitative analysis of the specific metal element can be applied, and for a specific infrared absorption present in the spreading agent, a quantitative analysis of an infrared absorption spectrum can be applied.

The spreading agent is preferably a solid at a room temperature, which is defined as 40° C. in this specification. A nucleating agent, a lubricant or a crystalline resin except a base resin are preferably used as the spreading agent. For example, possible nucleating agents are organic phosphates, organic carboxylates, sorbitol derivatives, inorganic powders, pigments or the like. Possible lubricants are aliphatic hydrocarbons, higher fatty acids, higher fatty acid alcohols, fatty acid amides, fatty acid esters, metallic soaps or the like. Possible crystalline polymers are polyamide resins, polyethylene resins, polyacetal resins, polybutylene terephthalate resins or the like.

Preferable nucleating agents, for example, are hydroxy-di(tertiary butylbenzoic acid)aluminum, p-tertiary butyl sodium benzoate, sodium benzoate, 1,3,2,4-diparamethyldibenzylidene sorbitol, 1,3-parachlordibenzylidene-2,4-parachlorbenzylidene-D-sorbitol, 1,3,2,4-dibenzylidene sorbitol, phenyl sodium phosphate, talc or the like. The preferable crystalline resins, except for the basic polymer, are high-density polyethylene, polycapramide, polybutyl terephthalate or the like.

An effective content of the spreading agent is in the range of 0.1 wt % to 11 wt %. When the content of the spreading agent is lower than 0.1 wt %, the fiber has a low spreadability and will not form a nonwoven fabric. An increased additive content enhances the spreadability of the fiber and, at the same time, increases the possibility of the fiber being split when spread. The additive content greater than 10 wt % causes splits and holes in the fiber and deteriorates the mechanical properties of the fiber, and thus such a fiber is unsuitable for forming a nonwoven fabric. Preferably, the additive content is in the range of 0.3 wt % to 2.5 wt %.

Generally, a commercial pp material containing two or three kinds of additives, such as an oxidation inhibitor, an ultraviolet absorber, a lubricant, a filler, a nucleating agent and an antistatic agent at a content in the range of 0.05 wt % to 0.5 wt % is used according to purpose. In most cases, the use of only a commercial i-pp resin is ineffective, which may be because the i-pp resin rarely contains an additive for improving the spreadability of the fiber and, if any, the content is as small as less than 0.1%. A resin capable of forming a fiber satisfying both the requisite spreadability and dimensional stability under heating is rarely available in the market. Accordingly, it is desirable to add appropriate additives to a commercial resin at an appropriate content.

A, B By the microwave birefringence ($\Delta n$) is meant the difference ($\Delta n = n_{MD} - n_{TD}$) between the refractive index ($n_{MD}$) in the direction of the fiber axis and the refractive index ($n_{TD}$) in the direction perpendicular to the fiber axis, determined by electromagnetic waves of the microwave region (the frequency range of from 0.3 GHz to 30 GHz). The orientation of the molecule, that is the orientation of the crystalline amorphous regions can be evaluated based on the microwave birefringence as well as the birefringence determined by the so-called optical measurement method using visible waves. For the fiber of the present invention having a non-circular cross-section, the measurement is difficult by the customary measurement method using a polarization microscope because the fibril thickness greatly differs and the method using microwaves is effective. By the long-period scattering intensity ratio is meant the value obtained by dividing the scattering intensity of the long period determined from the X-ray small angle scattering by the scattering intensity of the base line of the scattering intensity curve.

Note, either the microwave birefringence or the long-period scattering intensity ratio is determined in the state where the fiber is not spread but is gathered to a fiber axis. (Measuring method will be explained later.)

The dimensional stability under heating can be evaluated based on the elongation under heating and the thermal shrinkage. The elongation under heating can be measured by a thermal mechanical analysis apparatus. Namely, the elongation under heating is the elongation determined by applying a slight tensile load on the fiber (the load of 10% of the fineness expressed in terms of the of unit converted from the fineness expressed in terms of the denier unit) and elevating the temperature (5° C./min). The tensile load applied on the fiber is a load small enough for a precise measuring of the size of the fiber, and an occurrence of an elongation under such a small load means that a dimensional change is caused by a slight load imposed at a heat treatment such as heat setting or heat-bonding or at frictional contact with a roll, or by a tension imposed for preventing linearity or plainness defects such as bends or wrinkles. Accordingly, not only fibers but also fiber-piled webs are damaged by this dimensional change. It has been empirically found that if the elongation under heating of the fiber is 8% or less at 100° C. and 12% or less at 130° C., the occurrence of the above problem at the heat treatment is substantially eliminated.

The thermal shrinkage is measured by allowing the fiber to stand in the unrestricted state at 145° C. for 20 min in a hot air-circulated oven.

The highest temperature capable of retaining the dynamic elastic modulus of $5.0\times10^9$ dyne/cm$^2$, which is a criterion indicating the heat resistance, is 60° C. or more, preferably 100° C. or more, if the microwave birefringence is 0.07 or more. This temperature abruptly rises as the microwave birefringence is at 0.07.

Note, the dynamic elastic modulus is measured at a frequency of 110 KHz and a temperature-elevating rate of 2° C./min.

The above-mentioned requirements of the microwave birefringence must be satisfied, to obtain a fiber having a high dimensional stability under heating, especially a low elongation under heating. Further, a manifestation of the long-period structure is important to reduce the thermal shrinkage. Further more it has been found that it is necessary for a structure in which the molecular orientation including an amorphous portion is high and the fiber period is set in a good order, to satisfy the elongation under heating and the thermal shrinkage. In the references, it is taught that, if a fiber prepared by melt spinning is heat-treated, the long-period structure is set in good order and the long period is increased, but surprisingly, in a fiber spun from a solution at such a high spinning speed as 5000 to 15000 m/min, a long-period structure is clearly manifested in the as-spun state without a re-heat-treatment, and moreover, the X-ray scattering intensity ratio is high.

C A manufacturing method belonging to the classification C and of a fibrillated polypropylene three-dimensional plexifilamentary fiber in accordance with the present invention is a method of manufacturing by extruding a uniform solution composed of an isotactic polypropylene and a R-11 under a high pressure through a pressure let-down chamber and a spinneret to a low-pressure low-temperature zone, and characterized in that a pressure of the solution just before the solution passes through the pressure let-down chamber is an extinction initiation pressure or more, a temperature in the pressure let-down chamber is 198° C. or more and less than 220° C., a pressure in the pressure let-down chamber is an extinction initiation pressure or less and a melting flow rate (MFR) of the i-pp just before the extrusion satisfies the following requirement:

$$0.15 - 0.0014\,(T_{PF} - 198) \leqq \frac{MFR}{C} \leqq 1.74 - 0.029\,(T_{PF} - 198)$$

Wherein $T_{PF}$ stands for a solution temperature in the pressure let-down chamber, expressed by °C., and C stands for a concentration of pp expressed by wt %.

Preferably, the R-11 solution of the i-pp includes a spreading agent of 0.1 PHR to 11 PHR of the pp. Further, preferably the spread agent is a nucleating agent, a lubricant or a crystalline resin, except a base resin.

The extinction initiation pressure and the extinction termination pressure will be described hereunder.

FIG. 1 is a schematic view of a measuring apparatus. The light transmission quantity, namely, the quantity of light transmitted, of a solution contained in an autoclave 1 with a viewing window is observed by using tungsten light, while the temperature and pressure in the autoclave 1 are varied. Usually, a polymer is dissolved in a solution within the autoclave 1 under a high-temperature high-pressure condition, and valves 11 and 12 are opened to gradually discharge the solution so that the pressure is reduced to examine the light transmission quantity. At an extinction initiation temperature $T_{IE}$ and at an extinction initiation pressure $P_{IE}$, the light transmission quantity starts to decrease. At an extinction termination temperature TEE and at an extinction termination pressure $P_{EE}$, the light transmission quantity become zero, namely, the viewing window becomes dark. When necessary, a quantity of R-11, i.e., the solvent, which will not greatly vary the concentration of the polymer, is introduced by pressure into the autoclave 1 by a liquid booster 10 (Alps Koatsu K.K.) to apply a high pressure to the solution. The temperature of the solution is varied, while the pressure acting on the solution is increased and decreased repeatedly to determine the extinction initiation point and the extinction termination point. The heating duration and other conditions are the same as those for a spinning process using an autoclave, to avoid a variation of the molecular weight attributable to the thermal decomposition of the polymer. When necessary, an amount of a heat stabilizer which will not affect the phase diagram is added to the solution. The volume of the autoclave is 250 cm$^3$. It is considered that the extinction initiation temperature and the extinction initiation pressure correspond respectively to a temperature and a pressure at which the formation of a two-liquid-phase starts, and the extinction termination temperature corresponds to a temperature at which the formation of the two-liquid-phase is completed.

Figure 2:
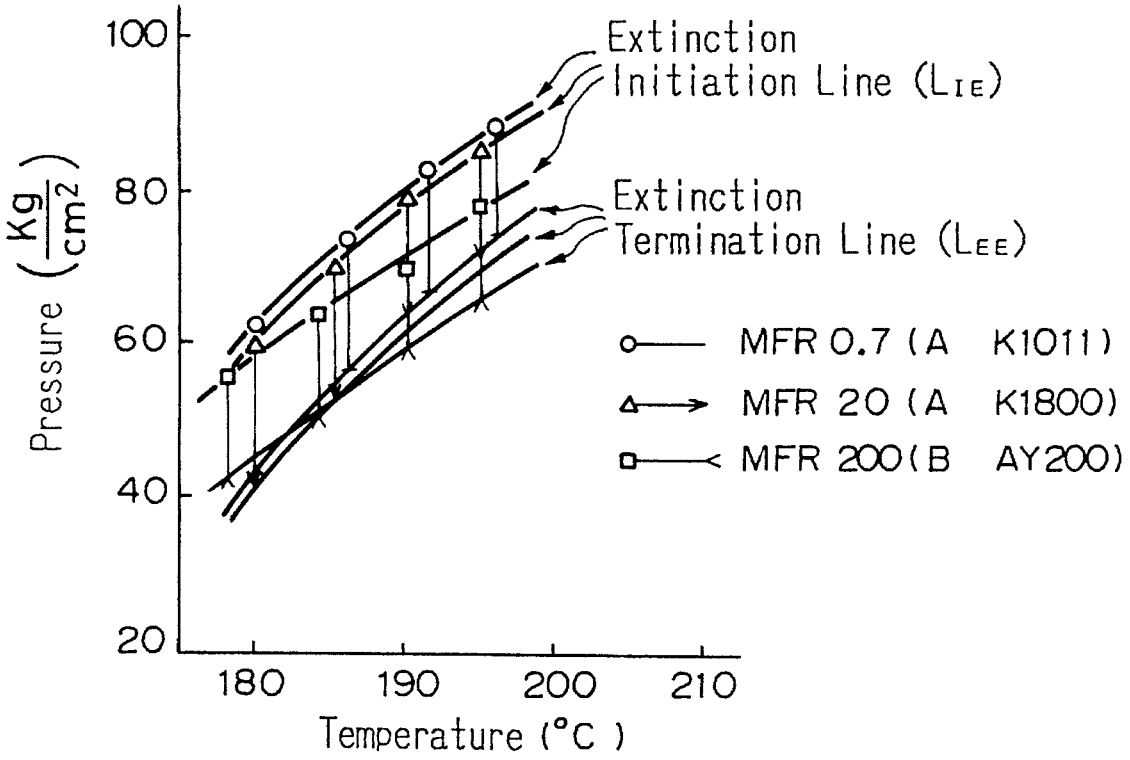
FIG. 2 is a graph of extinction initiation lines and extinction termination lines measured with respect to isotactic polypropylene/trichlorofluoromethane solvent systems comprising polymers differing in maker and MFR.

The inventors of the present invention examined the R-11 solutions respectively of i-pps supplied by different i-pp makers and found that the extinction termination points (each being a point of intersection of the extinction termination temperature and the extinction termination pressure) of those R-11 solutions scatter over a considerably wide range (the range of 10 to 40 kg/cm$^2$G in terms of solution pressure). The extinction termination points scattered over a certain range also when a laser beam (He-Ne laser beam of 6328 Å in wavelength) was used, though the range of scatter was narrower than that when the tungsten light was used. The quantity of light transmitted between the extinction initiation point and the extinction termination point was constant for several minutes, provided that the temperature and the pressure were constant. A change in the temperature or the pressure entailed an instant change in the quantity of light transmitted. Accordingly, the change cannot be considered to be a transient phenomenon resulting from the transition of the state (phase) of the solution. It is inferred that the variation of the extinction initiation point and the extinction termination point correspond to the distribution of the molecular weight of the polymer, but this is not obvious. FIG. 2 is a graph showing an extinction line $L_{IE}$, namely, a curve passing through initiation points, and an extinction termination line $L_{EE}$, namely, a curve passing through measured extinction termination points for 10% solutions of i-pps differing from each other in MFR. It can be seen from FIG. 2 that the extinction initiation points and the extinction termination points are scattered over wide ranges depending on the MFR, and it may be considered that such a mode of scatter applies to all the i-pps used in the present invention. With pp waxes having a number average molecular weight on the order of 4000, which are not included in the scope of the present invention, the extinction initiation point and the extinction termination point are little different from each other. An extinction initiation line and an extinction termination line are shown respectively for 13 wt % of i-pp of 0.7 in MFR, in FIG. 3.

The inventors of the present invention noted that the extinction initiation point and the extinction termination point are not different from each other (if any, in the solution pressure range of 1 to 4 kg/cm$^2$) in R-11 solutions of high-density polyethylene of most polymer grades except those of some polymer grades, while the extinction initiation point and the extinction termination point are different from each other in R-11 solutions of i-pps, and found through research into an improvement of the dimensional stability under heating of fibers that the degree of molecular orientation can be increased, a structure of a very long period can be formed, and thus a three-dimensional plexifilamentary fiber having a high dimensional stability under heating and having an excellent spreadability can be obtained, by adjusting the temperature of the solution and the pressure condition to specific conditions, adjusting the relationship between the MFR and concentration of the polymer to a value in a specific range. The present invention has been made on the basis of those findings.

First, i-pp and R-11 are charged in an autoclave so that a pressure higher than the vapor pressure is applied, and the mixture is heated to form a solution. The solution must be placed under a pressure over the pressure at the extinction initiation point before passing through the pressure let-down chamber to increase the dimensional stability under heating and the spreadability of the fiber.

Especially, in a method using a continuous spinning apparatus in which a pp resin is melted and blended with a solvent to be dissolved by a screw type extruder, it is important to elevate the solution pressure because a retention time of the solution in a solution forming zone is short. For example, the solution pressure is preferably $P_{IE}$+50 kg/cm$^2$G or more at the solution temperature 204° C. to 215° C., more preferably $P_{IE}$+120 kg/cm$^2$G or more.

Although the solution must be placed under a condition over the extinction initiation line in a zone before the solution is introduced into the pressure let-down chamber, the solution may be placed over the extinction termination line when the solution is introduced into the pressure let-down chamber, i.e., just before the solution is introduced into the pressure let-down chamber (See FIGS. 2 or 3), it is not always necessary for the solution to be placed under a temperature and pressure over the extinction initiation line.

As described herebefore the solution temperature may be optionally selected in a zone over the extinction initiation line in a place before the solution passes through the pressure let-down chamber, and in a zone over the extinction termination line in a place just before the solution passes through the pressure let-down chamber, under a condition that an absolute value of the solution temperature is in a zone having a lower temperature than the extinction termination temperature. However, when a higher temperature is used, a heat deterioration of the polymer and a heat decomposition of the solvent may occur, so that the deterioration of the polymer is accelerated and the spun fiber is yellowed. Preferably, the solution temperature is lower then 220° C.

Then, the solution is introduced into the pressure let-down chamber. The pressure let-down chamber can be constructed by arranging an orifice after a reservoir for the high-pressure solution. The number of pressure let-down chambers is not limited to 1. To increase the long-period scattering intensity ratio and microwave birefringence, especially the long-period scattering intensity ratio, a condition satisfying the following requirements must be maintained in the pressure reduction chamber just before the spinneret:

$$198 \leqq T_{PF} < 220,$$

$$P_{PF} \leqq P_{EE}$$

Wherein $P_{PF}$ stands for a pressure in the pressure let-down chamber. Namely, it has been found that the temperature and pressure, especially the pressure, in the pressure let-down chamber must be strictly controlled. In an extreme case, after the appropriate pressure is lower then 6 kg/cm$^2$G at a certain temperature. Under the condition where the pressure ($P_{PF}$) in the pressure let-down chamber is the extinction termination pressure, that is, under the condition of $P_{PF} \leqq P_{EE}$, the long-period scattering intensity ratio is not increased, and therefore, the thermal shrinkage and the elongation under heating tend to increase. Moreover, particles not fibrillated are observed in the spun fiber, and the strength of the fiber is low although the elongation is high.

Under the condition of $P_F \leqq P_{EE}-30$ and $P_{PF} \geqq 43.6$, that is, under the condition where the pressure is lower than the extinction termination pressure minus 30 kg/cm$^2$G and the pressure is lower then the critical pressure of R-11, i.e., 43.6 kg/cm$^2$G, breaking of fibrils occurs, the microwave birefringence is low and the elongation under heating becomes high. The longperiod scattering intensity ratio tends to decrease, but in this fiber, the thermal shrinkage is not elevated because of the low molecule orientation and the breaking of fibrils.

Preferably, the temperature of the solution in the pressure let-down chamber is adjusted to 198° to 220° C. If the solution temperature is lower than 198° C., the flowability of the solution is low and the flushing force is small, and therefore, the drawability of the fiber extruded from the spinneret is reduced and the microwave birefringence is not elevated. If the solution temperature is higher than 220° C., adhesion occurs among fibrils and spreading is difficult. Moreover, the temperature of the stream extruded from the spinneret is high and the polymer is not crystallized, and therefore, the orientation is degraded and reduction of the elongation under heating is impossible. Especially preferably, the solution temperature is 204° to 212° C.

The temperature of the pressure let-down chamber can be measured by setting the detection end of a thermocouple type heat detector so that influences of heat transferred from the wall of the pressure let-down chamber are eliminated. In particular, the detector must be designed so that the size of the temperature detecting end is small and the heat capacity is small.

To increase the microwave birefringence, the relationship among the MFR and concentration C of i-pp just before the extrusion and the solution temperature TPF must satisfy the following requirement.

$$0.15 - 0.0014\,(Tp_F - 198) \leqq \frac{MFR}{C} \leqq 1.74 - 0.029\,(TpF - 198)$$

Preferably, the upper limit satisfies the requirement of $$\frac{MFR}{C} \leqq 1.42 - 0.029\,(TpF - 198).$$

Figure 4:
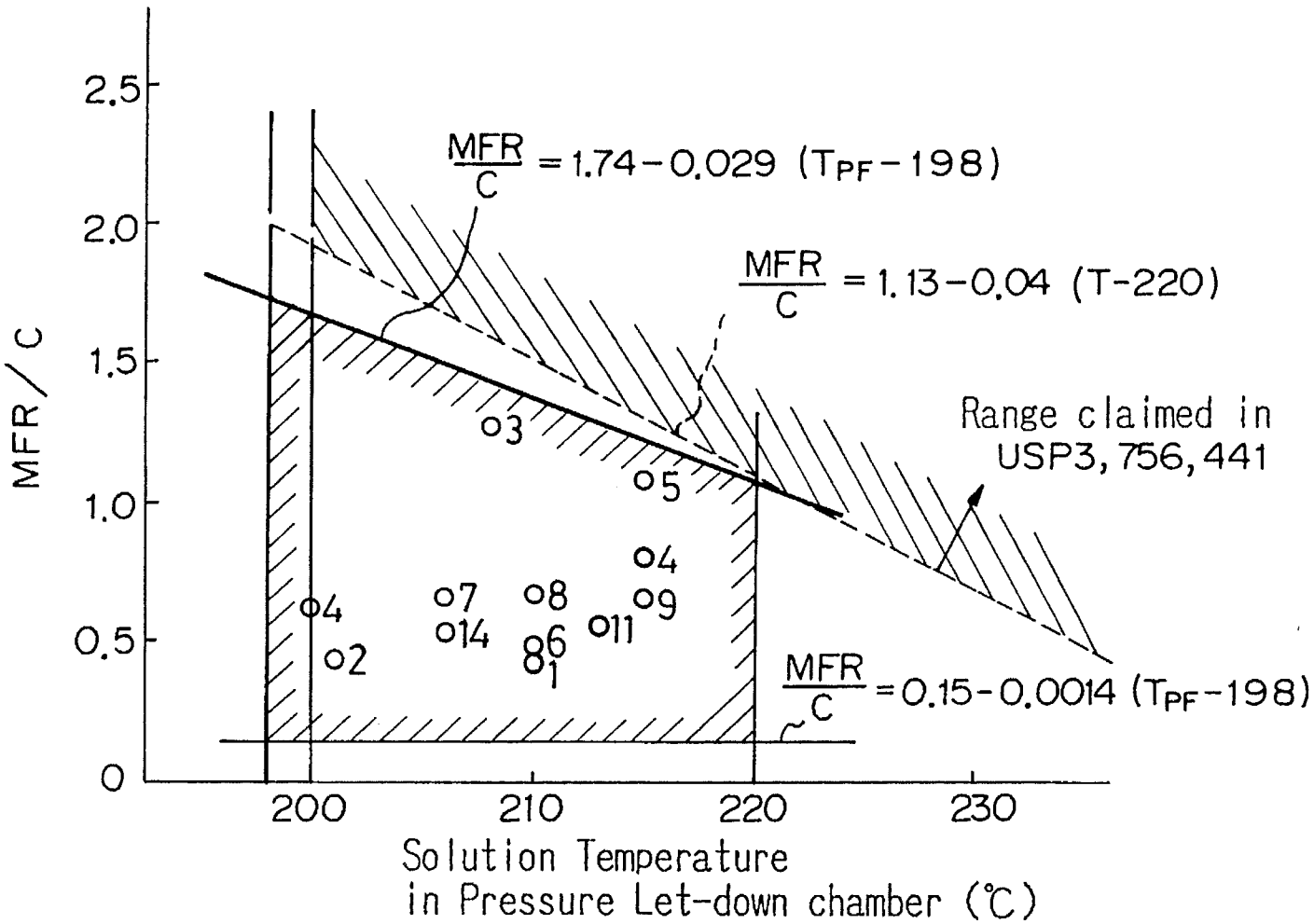
FIG. 4 is a graph of an appropriate range of a relationship between a solution temperature just before an extrusion (in the pressure let-down chamber) and ratio MFR/C of MFR of the polymer just before the extrusion to the polymer concentration according to the present invention and a range of this relationship by a conventional technique, in which conditions of examples are plotted by corresponding numerals.

In this case, the solution is in a high-viscosity region, as shown in FIG. 4, and the solution temperature is 198° to 220° C. and is relatively low. It is considered that, since the viscosity of the solution is very high, the polymer molecule is easily oriented and a fiber having a higher microwave birefringence is provided. In the region of MFR/C<0.15–0.0014 (TpF-198), the flowability of the solution is too low, and therefore, the polymer molecule is not easily oriented and a fiber having a high microwave birefringence is not obtained. Moreover, the polymer is not easily dissolved and a fiber having a good configuration is not obtained.

Preferably, the MFR of the polymer just before the extrusion is below 20. If the value of MFR exceeds 20, the thermal stability is low, and the polymer easily melts. More preferably, MFR is 10 or less MFR of the spun fiber is adopted as MFR of the polymer just before the extrusion. MFR is measured at a temperature of 230° C. under a load of 2.16 kg by using a melt indexer supplied by Toyo Seiki Seisakusho according to JIS K-7210.

It is sufficient if the i-pp concentration in the solution is 7 wt % to 17 wt %. If the i-pp concentration is lower than 7 wt %, it is difficult to adjust the microwave birefringence to an appropriate level. A higher polymer concentration is preferred and polymer concentration of 9 wt % or more is especially preferred. However, with an increase of the polymer concentration, the spreadability of the fiber is degraded. When the polymer concentration is higher than 17 wt %, even if MFR of the polymer is 20, a satisfactory flowability cannot be given to the solution at a solution temperature of 198° to 220° C. in the pressure reduction chamber. Moreover, a highly spread fiber composed of fine fibrils can not be obtained.

In the present invention, i-pp used comprises about 85 wt % or more of i-pp and may comprise pp other than i-pp or a polymer component such as ethylene, n-butylene, isobutylene, vinyl acetate or methyl methacrylate in an amount of up to about 15 wt %. Moreover, additives such as an antioxidant, an ultraviolet absorber, a lubricant, a filler, a nucleating agent and an antistatic agent can be added in such amounts as not degrading the characteristics of i-pp.

The dissolution of the polymer and the extrusion of the solution can be accomplished not only by the batchwise method using an autoclave or the like but also by the continuous method using a screw extruder or the like.

A R-11 solution of i-pp must include a spreading agent of 0.1 PHR to 11 PHR, to obtain a fiber having a high dimensional stability under heating and a high spreadability. PHR denotes a weight of the spreading agent for 100 weight portion of the resin. Moreover, preferably the spreading agent is a nucleating agent, a lubricant or a crystalline resin except a base resin, as described herebefore. Either a method of striking a stream extruded from a spinneret against an impingement plate or a method using a spinneret with rectangular grooves may be used as a method for spreading the fiber.

The spreading agent may be added to the polymer at any stage in the process before preparing the solution. The spreading agent may be added in materials in charging an autoclave with the materials to dissolve the polymer by using the autoclave in a batch system. When a screw extruder is employed for preparing the solution, the spreading agent may be added to the polymer in extruding the polymer or before extruding the polymer. A small part of the spreading agent is lost together with the solvent after the solution has been extruded through the spinneret but most of the spreading agent remains in the fiber, which can be proved by analyzing the fiber to find the content of the spreading agent. When a nucleating agent is added to the solution, the temperature of crystallization is increased by 1° to 20° C., which is effective for increasing the degree of molecular orientation of the fiber and enhancing the dimensional stability under heating of the fiber.

Although some spreading agents, such as benzonates, inorganic powders and polyamide resins, are difficult to dissolve in a solvent under a high-temperature and high-pressure condition, the spreading agents are effective provided that the spreading agents are uniformly dispersed and mixed in the solution. However, since undissolved spreading agents are liable to clog the spinning hole of the spinneret, it is desirable to use spreading agents of a fine grade, for example, a 500 mesh sieve passing grade.

The fibers described in the classifications A and B and a fiber manufactured by the method described in the classification C have specific values of microwave birefringence, long period scattering intensity ratio, and quantity of the spreading agent, as described herebefore. Moreover those fibers have specific values of an angle of orientation determined by x-ray diffraction, a half-value width of the peak of diffraction from a crystal face 110, a long period, the apparent density, a dependence of the dynamic elasticity on temperature, a specific area and the spreadability (the number of free fibrils and width of the fiber). Those values will be explained hereafter. However, the polypropylene three-dimensional plexifilamentary fibers are not limited by the above values.

The angle of orientation determined by x-ray diffraction is 36° or less, preferably, 30° or less. The half-value width of the peak of diffraction from the crystal face 110 is 2.6° or less. The long period is not less than 75 Å and not more than 140 Å. The apparent density is 0.895 g/cm$^3$ or more and, mostly, 0.900 g/cm$^3$ or more. The specific surface area is in the range of 2 m$^2$/g to 30 m$^2$/g. The number of free fibrils is 150/50 d or more. The width is 20 mm/100 d or more, preferably, 30 mm/100 d or more.

D A nonwoven fabric belonging to a classification D and composed of the pp three-dimensional plexifilamentary fiber in accordance with the present invention will be now described.

The nonwoven fabric in accordance with the present invention is composed of the fibrillated polypropylene three-dimensional plexifilamentary fiber and is characterized in that a microwave birefringence in a cross section of the nonwoven fabric is 0.06 or more.

A nonwoven fabric in accordance with the present invention has been obtained on the basis of a finding that there is a correlation between the elongation under heating affecting the dimensional stability under heating and the microwave birefringence in the cross section of the nonwoven fabric. Namely, if the microwave birefringence in the cross section is 0.06 or more, the problems that the elongation under heating is low, and a dimension of the nonwoven fabric is varied by a slight stretching load when the nonwoven fabric is exposed under the heating environment, are eliminated.

The microwave birefringence in the cross section (abbreviated to $\Delta n_S$) in the specification is defined as a microwave birefringence having a small value within two values of microwave birefringence ($\Delta n_{S.MD}=n_{MD}-n_T$ or $\Delta n_{S.TD}=n_{TD}-n_T$) obtained, respectively by difference between refractive indexes in a length wise direction or a transverse direction in the cross section of the nonwoven fabric (abbreviated to $n_{MD}$, $n_{TD}$, respectively) and a refractive index in the thickness direction of the nonwoven fabric (abbreviated to $n_T$). There is not much difference between $\Delta n_{S.MD}$ and $\Delta n_{S.TD}$ except that the nonwoven fabric is manufactured by accumulating the plurality of three-dimensional plexifilamentary fibers and bonding the fibers to each other, and then further stretching the obtained nonwoven fabric to make a nonwoven fabric having different values of orientation in the lengthwise direction and the transverse direction of the nonwoven fabric.

The lengthwise direction (MD) of the nonwoven fabric is defined as a running direction of the nonwoven fabric when manufacturing the nonwoven fabric, and the transverse direction (TD) of the nonwoven fabric is defined as a direction perpendicular to the lengthwise direction. The microwave birefringence in the cross section is a refractive index obtained by irradiating and measuring a microwave in a direction perpendicular to the cross section toward the cross section of the nonwoven fabric. For example, when the microwave birefringence is intended to obtain a difference between a refractive index in the lengthwise direction and that in the transverse direction, a plurality of nonwoven fabrics are piled such that directions of the nonwoven fabrics coincide, cutting the nonwoven fabric in the lengthwise direction to an internal corresponding a thickness of a sample to be measured to make a sheet having cross sections as an upper surface and a lower surface. A size of the sample actually measured has a length, i.e., MD direction of the nonwoven fabric, of 75 mm, a width, i.e., the thickness direction of the nonwoven fabric, of 10 mm, and a thickness, i.e., TD direction of the nonwoven fabric, of 1 mm. The microwave is irradiated in a direction perpendicular to the cross section, and the refractive indexes of the lengthwise direction and the direction perpendicular thereof, i.e., the thickness direction of the nonwoven fabric is obtained by a polarized direction of the microwave. The difference between the above two refractive indexes is a birefringence in the lengthwise direction on the cross section. A value of the actual thickness corresponding to a polymer component of the sample is needed to calculate the microwave birefringence, and this value is obtained by measuring a weight of the sample and calculating the width and density of the sample.

When the microwave birefringence is 0.06 or more, an elongation under heating at 100° C. become to about 15% or less. A nonwoven fabric having the elongation under heating of about 15% or less at 100° C. has no problems caused by change of a dimension of the nonwoven fabric appearing during a heat treatment.

When the microwave birefringence in the cross section is lower than 0.06, the elongation under heating is remarkably elevated and is not recommendable.

The microwave birefringence in the cross section in the nonwoven fabric composed of the PP three-dimensional plexifilamentary fiber depends on a molecular orientation of the three-dimensional plexifilamentary fiber constituting the nonwoven fabric, an orientation of the fiber in the cross section of the nonwoven fabric, and a temperature and a pressure at a bonding process or the like. The higher the microwave birefringence, the higher the high molecular orientation of the fiber and the high orientation of the fiber in the cross section of the nonwoven fabric. Further, when the temperature and the pressure at the bonding process of the piled web of the three-dimensional plexifilamentary fibers are high, the microwave birefringence in the cross section is elevated. For example, a microwave birefringence in the cross section of the nonwoven fabric obtained by bonding the web by pressing between a heated metal roll and a rubber roll under a high pressure, is higher than that of the nonwoven fabric obtained by bonding the web by a felt calender, i.e., bonding under a lower pressure pressing treatment. Moreover, when the heated metal roll and the rubber roll are used under the same pressure, the higher temperature of the metal roll changes the high microwave birefringence in the cross section.

The microwave birefringence in the cross section depends on serial factors as described hereinafter, however, the microwave birefringence and the elongation under heating have a good correction, except that the fibers of the nonwoven fabric are bonded in a lower grade and can not endure an ordinary use of the nonwoven fabric, for example, where an abrasion resistance and a fuzz resistance of a surface of the nonwoven fabric are insufficient.

The nonwoven fabric in accordance with the present invention has a uniformity of an orientation in a plane and uniformity of a thickness, a weight per unit area, and an appearance such as a whiteness, opacity or the like are superior, in addition to a high orientation in the plane. To provide the additional feature to the nonwoven fabric, preferably a spreadability of the three-dimensional plexifilamentary fiber constituting the nonwoven fabric is improved by adding a spreading agent of 0.1 wt % to 10 wt % into the fiber. A fiber width up to 45 mm/150 d, at least a fiber width of 20 mm/150 d or more, can be obtained by adding the spreading agent of 0.1% to 10 wt % into the fiber and striking the fiber against an impingement plate capable of spreading the fiber. The uniformity of the orientation of the fiber in the plane can be obtained by this fiber, and the uniformity of the weight per unit area, the thickness and the appearance are improved. Therefore, a nonwoven fabric having a small weight per unit area, i.e., a thin thickness, can be obtained. When manufacturing the nonwoven fabric by dispersing in a plane a fiber having a low spreadability, that is, a fiber having fiber width of about 15 mm, and piling the fibers, the arrangement of the fibers is often biased by a shape of the impingement plate and precision of the rotation and vibration of the impingement plate, and an irregularity of the orientation in the plane, the thickness and the appearance is often generated, and an irregularity of the appearance and holes are often generated because it becomes difficult to cover the spaces between the fibers.

When a quantity of the spreading agent is 0.1 wt %, the spreading effect is reduced, and when the quantity of the spreading agent is much more than 10 wt %, splits or holes in the fiber remarkably increase. Therefore, a preferable quantity of the spreading agent is 0.3 wt % to 2.5 wt %.

The spreading agent is preferably a nucleating agent, a lubricant or a crystalline resin, except a base resin.

A further preferable nonwoven fabric in accordance with the present invention has features including a specific value of a microwave birefringence in a cross section, use of a three-dimensional plexifilamentary fiber including a spreading agent, a difference of 0.02 or less between a lengthwise direction and a transverse direction of a microwave refractive index in a plane, and a variation ratio of laser beam transmission intensity of 150% or less.

The difference between the lengthwise direction and the transverse direction of a microwave refractive index in the plane ($\Delta n_p$) is a difference between a microwave refractive index in a lengthwise direction (MD) and a microwave refractive index in a transverse direction (TD) measured by a polarized direction of the microwave when measuring the microwave refractive index in the plane by irradiating a microwave in a direction perpendicular to a surface of the nonwoven fabric $$[\Delta n_p = |n_{MD} - n_{TD}|].$$

When the difference between a microwave refractive index in the lengthwise direction and that in the transverse direction is 0.02 or less, an orientation in the plane is uniform. This value corresponds to a ratio of about 1.6 or less of tensile strength between both directions corresponding to the directions in the refractive index, respectively. A preferable value of $\Delta n_p$ is 0.01 or less and this value corresponds to about 1.3 or less in the ratio of tensile strength. A more preferable value of the $\Delta n_p$ is 0.005 or less, and more preferable value of the ratio of tensile strength is about 1.15 or less, and thus an extremely good uniformity of the orientation in the plane may be obtained.

A microscopic irregularly in a transverse direction of the nonwoven fabric can be determined by a variation ratio of laser beam transmission intensity, and the nonwoven fabric in accordance with the present invention has a variation ratio of 150% or less, and thus has a superior microscopic uniformity.

A variation ratio of laser beam transmission intensity of a nonwoven fabric of an ordinary PP three-dimensional plexifilamentary fiber is over 150%. The variation ratio is preferably 100% or less, more preferably 50% or less in the present invention. Thus, it become possible to manufacture a nonwoven fabric having a small microscopic irregularity by manufacturing a three-dimensional plexifilamentary fiber having a high spreadability by applying a striking operation.

The nonwoven fabric in accordance with the present invention is a nonwoven fabric having fibers having the various characteristics described hereinbefore.

When the microwave birefringence of the three-dimensional plexifilamentary fiber constituting the nonwoven fabric is 0.07 or more, preferably 0.10 or more, a nonwoven fabric having a low elongation under heating can be obtained. Namely the elongation under heating is about 15% or less at 100° C., preferably about 10% or less. Moreover, when the long period scattering intensity ratio of the three-dimensional plexifilamentary fiber constituting the nonwoven fabric is 5 or more, preferably 15 or more, a nonwoven fabric having a low thermal shrinkage can be obtained. Namely the thermal shrinkage is about 5% or less, preferably about 2.5% or less. This thermal shrinkage was measured by keeping the nonwoven in an unrestrained state in an oven in which hot air is circulated at 145° C. for 20 minutes.

When the nonwoven fabric is kept in 135° C. steam for 30 minutes in an autoclave, the thermal shrinkage is 2% or less, preferably, 0.5% or less and the smoothness of the surface is not affected, which proves that the nonwoven fabric has a superior heat resistance. When a heat-bonded three-dimensional plexifilamentary high-density polyethylene nonwoven fabric is exposed to the same thermal conditions, the thermal shrinkage is 10% or more and large irregularities are formed in the surface, and thus the nonwoven fabric composed of the pp three-dimensional plexifilamentary fiber in accordance with the present invention has a superior dimensional stability under heating.

A method of manufacturing the nonwoven fabric in accordance with the present invention and various concrete types of nonwoven fabric obtained by this manufacturing method will be described hereafter.

The three-dimensional plexifilamentary fiber can be obtained by a method described hereinbefore.

A method of dispersing uniformly spread fibers to make an accumulated material is performed by using a rotary dispersing plate serving also as means for spreading fibers, a corona discharger for stabilizing the piling of the fibers, and a movable net conveyor, as disclosed in U.S. Pat. No. 3,456,156. Namely, fibers are discharged through a spinneret to impinge on the rotary dispersing plate and spread and disperse the fibers, and the fibers are charged and are accumulated in a sheet on the net conveyor. The sheet of the fibers is compressed between a pair of pressure rollers or the like to form a contact-bonded nonwoven fabric.

Although the contact-bonded nonwoven fabric itself meets the requirements of the present invention and has many uses as a material for filters, adsorbers, oil absorbent sheets, wiping cloth, electric sheets, masks, heat insulating sheets, heat insulating materials, wadding and the like, the contact-bonded nonwoven fabric is heat-bonded to provide a further useful nonwoven fabric having a good mechanical strength and a surface stability such as an abrasion resistance, fuzz resistance, or the like. An adhesive, heating, needle punching, interlacing by a high speed water Jet or the like can be used as the bonding method. However, the bonding method by heating is most convenient.

Heat-bonding can be achieved by a heat roller press process, a calender roller process or a felt calender process. The degree of adhesion of the fibers, the mode of adhesion of the fibers, the surface pattern of the nonwoven fabric are dependent on the temperature, heating time and pressing pressure of the process. Thus, a variety of nonwoven fabrics varying in appearance and physical properties such as mechanical strength, permeability or the like can be obtained.

The heat-bonded plexifilamentary PP nonwoven fabric thus manufactured has an elongation under heating of 15% or less at 100° C., preferably 10% or less.

The thermal shrinkage is about −2% to 4%, which depends on the conditions of heat-bonding process, i.e., temperature, heating time, pressure or the like.

Note, a thermal shrinkage of the contactbonded nonwoven fabric is about 2.0% to 5.0%, and it is possible to reduce the thermal shrinkage by applying the heat-bonding. A long period scattering intensity ratio of the three-dimensional plexifilamentary fiber constituting the nonwoven fabric is elevated by a heating process.

Even if the nonwoven fabric is applied with the heat-bonding to increase an abrasion resistance of a surface of the nonwoven fabric, a many unfused and independent fibers having a plexifilamentary configuration may be pulled out from an inside of the nonwoven fabric. Especially these fibers can be obtained from a nonwoven fabric bonded in a state of points by an emboss roller or an nonwoven fabric applied with a softening treatment. Thus it is possible to evaluate the characteristics of the three-dimensional plexifilamentary fiber constituting the nonwoven fabric from the above-mentioned type of the nonwoven fabrics.

Other properties of a typical heat-bonded plexifilamentary PP nonwoven fabric of the present invention are shown below, which do not limit the plexifilamentary PP nonwoven fabric of the present invention.

| | |
|---|---|
| Weight per unit area: | 15 to 200 g/m$^2$, preferably, 20 to 120 g/m$^2$ |
| Thickness: | 0.05 to 1.0 mm, preferably 0.07 to 0.5 mm |
| Tensile strength: | 2 to 13 kg/3 cm/50 g/m$^2$, preferably, 5 kg/30 cm/ 50 g/m$^2$ or more |
| Elongation: | 10 to 40% |
| Tensile strength ratio: | 0.6 to 1.6, preferably 0.8 to 1.3 |
| Elemendorf tear strength: | 0.05 to 1.0 kg/50 g/m$^2$, preferably, 0.2 kg/ 50 g/m$^2$ or more |
| Water resistance: | 200 to 3000 mm$H_2O$/ 50 g/m$^2$ |
| Gurley permeability: | 1 to 1000 sec/100 cc |
| Whiteness: | 85 to 96% |
| Untransparency: | 80 to 97% |
| Uniformity: | 0.2 to 0.6% |
| Variation Ratio of Laser Beam Transmission Intensity: | 40 to 150% (Weight per unit area 50 g/m$^2$) |

Various functional aptitudes for specific applications can be added to the heat-bonded nonwoven fabric by subjecting the heat-bonded nonwoven fabric to various finishing processes, such as a corona discharge process, a static electricity eliminating process, a process for providing the nonwoven fabric with a hydrophilic property, a softening process, a perforating process, a laminating process or the like.

As mentioned above, the excellent properties of the plexifilamentary PP nonwoven fabric of the present invention in elongation under heating, thermal shrinkage, uniformity in surface orientation, thickness, weight per unit area and appearance enable the effective application of the nonwoven fabric to the following uses.

Lint-free clothes, aseptic clothes, protective (safety) clothes, operating clothes, working clothes (special work in chemical plants, nuclear power plants, asbestos cleaning), casual wear, simple clothes, aprons, gloves, caps, sanitary shorts, simple raincoats, diaper covers, wadding, sterilized packaging materials, fresh packaging materials (for packaging flowers, vegetables and fruits), desiccant packaging materials (dehumidifying agent packaging materials), heat generating agent packaging materials, permeable packaging materials, document storage bags, envelops, miscellaneous bags, floppy disk envelopes, sterilizing paper (for autoclave sterilization), impregnated papers, adsorbent papers (corrosion preventive papers, fragrant papers, deodorant papers, insect proof papers, ant proof papers, rust preventive papers), papers for furniture, interior decoration papers, water-resistant papers, recording papers (thermographic papers, ink jet recording papers, electrostatic recording papers), super lightweight papers, papers for FRPs, synthetic papers, labels, tags, posters, catalogs pamphlets, sign boards, maps, book covers, schedule tables, curtains, substitutes for Japanese papers, sheets masks, covers, wiping cloth, separators for batteries, electret sheets, filters, lining materials, tape foundations, heat insulating materials, heat insulating linings, carpet backings, shock absorbing materials, goods for clean rooms (lint free note), sanitary articles, moisture permeable wallpapers, roofings, ceiling materials, framed textile forms, agricultural materials (curtains for greenhouses, reflective sheets).

The definitions of various physical properties and measuring methods thereof used in the present invention will be given, hereafter, except for the physical properties described hereinbefore.

The thickness was measured by a dial gauge having contact pads 10 mm in diameter, at a contact pressure of 10 g/cm$^2$.

The tensile strength and the elongation were measured by an Instron tensile tester at a gauge length of 100 mm and a pulling speed of 200 mm/min.

The tear strength was measured by an Elemendorf tear tester. A transverse cut was formed in the sample when measuring the longitudinal strength, and a longitudinal cut was formed in the sample when measuring the transverse strength.

The water resistance was measured by a method specified in JIS L 1092.

The Gurley permeability was measured by a densometer of Gurley B type.

The whiteness was measured by a method specified in JIS P 8123.

The opacity was measured by a method specified in JIS P 8138.

The laser beam transmission was measured by irradiating a nonwoven fabric with a He-Ne laser beam (wave length of 6328 Å) of 5 mW in incident laser light intensity and 2.5 mm in diameter in a dark room and measuring the intensity of the laser beam transmitted through the nonwoven fabric by a powermeter. A range of variation of the laser beam transmission intensity is a value obtained by continuously applying the irradiation of the laser beam in the transverse direction (TD) of the nonwoven fabric and calculating a difference between a maximum value and a minimum value of the transmission intensity. The variation ratio of closer beam transmission intensity is a value dividing the range of variation of laser beam transmission intensity by a mean value of the laser beam transmission intensity. The laser beam transmission ratio is a value dividing the laser beam transmission intensity by the intensity of the incident laser beam.

A pp filament nonwoven fabric 50 g/cm$^2$ in weight per unit area produced by a melt spinning method has a laser beam transmission ratio of 5.2% and a variation ratio of laser beam transmission intensity of about 160%, which proves the superior covering and the superior uniformity of the appearance of the nonwoven fabric in accordance with the present invention.

The elongation under heating is measured at a temperature-elevating rate of 5° C./min over a range of from 30° to 170° C. by using a thermal mechanical analysis apparatus (TMA-40 supplied by Shimazu Seisakusho K.K.).

When measuring the nonwoven fabric, a stretching load of 405 g/m$^2$ is used for a cross section of an sample, the weight of which is to be measured.

A width of the sample is 0.5 mm to 1.0 mm and a distance between both fasteners is 2 mm–4 mm.

When measuring the fiber, the fineness of the fiber is measured and the denier unit is converted to the gf unit and the measurement is conducted under a tensile load corresponding to 10% of the obtained fineness value (a load of about 810 gf/mm$^2$).

The microwave birefringence is measured at a frequency of 4.0 GHz by a microwave molecule orientation meter (Model MOA-2001 Å supplied by Kanzaki Seishi K.K.). Specimens used for the measurement are prepared by arranging the fiber in the parallel state in holders such that a width of the fiber is 10 mm, a necessary length is 75 mm and a substantial thickness is about 100 μm. The substantial thickness, which is necessary for calculating the microwave birefringence, is calculated from a number, fibers, and density of the fibers.

The X-ray small angle scattering is determined by measuring the scattering intensity of CuKα ray in the direction of the meridian line by using a small angle scattering apparatus comprising a rotating anticathode type strong X-ray generator, Rotaflex RU-200A, to which a multichannel pulse analyzer (supplied by Rigaku Denki K.K.) and a position sensive proportional counter (PSPC) are attached.

The voltage of the tube is 50 kV, the electric current of the tube is 200 mA, and the first slit and second slit have a width of 0.2 mm and a length of 3 mm. The distance between the PSPC and the specimen is about 1170 mm.

The long period is determined from the position of the peak of shoulder of the scattering intensity curve (the position indicating the maximum scattering intensity). The long-period scattering intensity is determined from the scattering intensity between the scattering intensity curve indicating the long period and the common tangential line of curves above and below the long-period scattering, and the long-period scattering intensity ratio is determined by dividing this long-period scattering intensity by the scattering intensity at the base line (the position of 2θ=2.1 to 2.4) of the intensity curve. The correction compensating the scattering of air is made to the X-ray small angle scattering. If the correction is not performed, the long term scattering intensity ratio may be reduced to a small value.

The dynamic viscoelasticity is measured at a frequency of 110 KHz and a temperature-elevating rate of 2° C./min by using an automatic viscoelasticity measuring device (RHEOVIBRON DDV-II-EA supplied by Toyo-Boldwin K.K.).

The tensile strength and elongation of the fiber are measured at a pulling speed of 200 mm/min by an Instron type tensile tester with respect to a sample twisted at 8 turns per cm.

The orientation angle by the X-ray diffractometry is the half value width of the diffraction peak measured by rotating the sample in the plane where the irradiated X-ray is vertical to the sample, in the diffraction angle from the 110 plane of the crystal face (2θ=14.2° to 14.8°, θ=Bragg angle). A rotating anticathode super-strong X-ray apparatus (Model RAD-γA using CuKΔ ray and supplied by Rigaku Denki K.K.) is used as the X-ray diffraction apparatus. Since the diffraction peak from the 110 plane overlaps the diffraction peak of 2°θ=16.5 to 16.8° (the diffraction peak from the 040 plane) on the higher diffraction angle side, the half value width between the perpendicular line drawn from the diffraction peak from the 110 plane and the diffraction line on the lower diffraction angle side is determined, and the half value width of the diffraction peak from the 110 plane is determined by doubling the so-obtained half value width.

When the spread yarn is measured, measurements such as the microwave birefringence, the long period scattering intensity, the thermal mechanical analysis, the thermal shrinkage, the dynamic viscoelasticity, the wide angle X-ray diffraction is not applied to a fiber spread in the direction perpendicular to the fibers axis, but to a fiber collected to the fibers axis. The fineness and the length of fiber are measured by converting the denier unit to a gf unit and conducting the test under a tensile local corresponding to 10% of the obtained fineness value.

The apparent density is measured at 25° C. by using a density gradient tube comprising toluene and chlorobenzene.

The specific surface area is measured by using Soapty 1750 supplied by Amoco K.K.

The present invention will now be described with reference to the following various examples.

EXAMPLES 1 TO 2

An autoclave having an inner volume of 534 $cm^3$ was charged with 79.3 g of i-pp having MFR of 0.7 (Polypro K1011 supplied by Chisso K.K.) and 531 g of R-11 (the polymer concentration was 13 wt %), the autoclave was heated while rotating a propeller type stirrer, whereby i-pp was dissolved (at about 90° to about 110° C.).

The solution temperature was measured by the detection end of a thermocouple type thermometer inserted in the autoclave, and the solution pressure was detected by the detection end of a diaphragm type pressure detector inserted in the autoclave.

The solution is further heated and the solution pressure elevates to 250 $kg/cm^2G$ to 300 $kg/cm^2G$. The polymer was already completely dissolved at this point. This pressure is much higher than an extinction initiation pressure. The solution is exhausted from an exhaust nozzle or a bottom of the autoclave, to prevent a further elevation of the pressure and to keep the pressure constant. At the point at which the solution temperature was elevated to a predetermined level (by conducting heating for about 55 to about 75 minutes), the quantity of the solution was further reduced to adjust the pressure to a level lower by 3 to 5 $kg/cm^2G$ than the predetermined pressure for compression. Then, the solution temperature was maintained at the predetermined level again, and the stirrer was stopped, a valve arranged in the upper portion of the autoclave was opened and $N_2$ gas was introduced to conduct compression under the predetermined pressure. Immediately, a discharge valve arranged in the lower portion of the autoclave was opened, and the solution was passed through a pressure let-down orifice (having a diameter of 0.7 mm and a length of 5 mm) and guided into a pressure let-down chamber (having a diameter of 8 mm and a length of 80 mm). Then, the solution was passed through a spinneret (the angle of introduction to a nozzle hole to the pressure let-down chamber was 60°, the nozzle hole diameter was 0.5 mm, the nozzle length was 0.5 mm, and the nozzle had a circular groove having an outlet diameter of 3.0 mm and a depth of 3.0 mm, which was formed with the nozzle hole being as the center around the nozzle) and was released into the open air.

The same temperature and pressure detection ends as used for the autoclave were inserted into the pressure let-down chamber to measure the temperature and pressure. The temperature values recorded on a chart were read. The solution temperature in the pressure let-down chamber was controlled by heating the temperature of a conduit (100 mm or more) extended from the autoclave to the pressure let-down chamber and the temperature of the pressure let-down chamber by adjusting a heater.

In this example, spinning was carried out while controlling the spinning conditions so that the microwave birefringence of the spun fiber was 0.07 or more and the long-period scattering intensity ratio was 10 or more. More specifically, the temperature and pressure of the solution just before passing through the pressure let-down chamber were controlled so that they exceeded the extinction termination line. In the pressure let-down chamber, the temperature was controlled to a level of 198° C. to 220° C., and the pressure was controlled to the extinction termination pressure or less.

Figure 3:
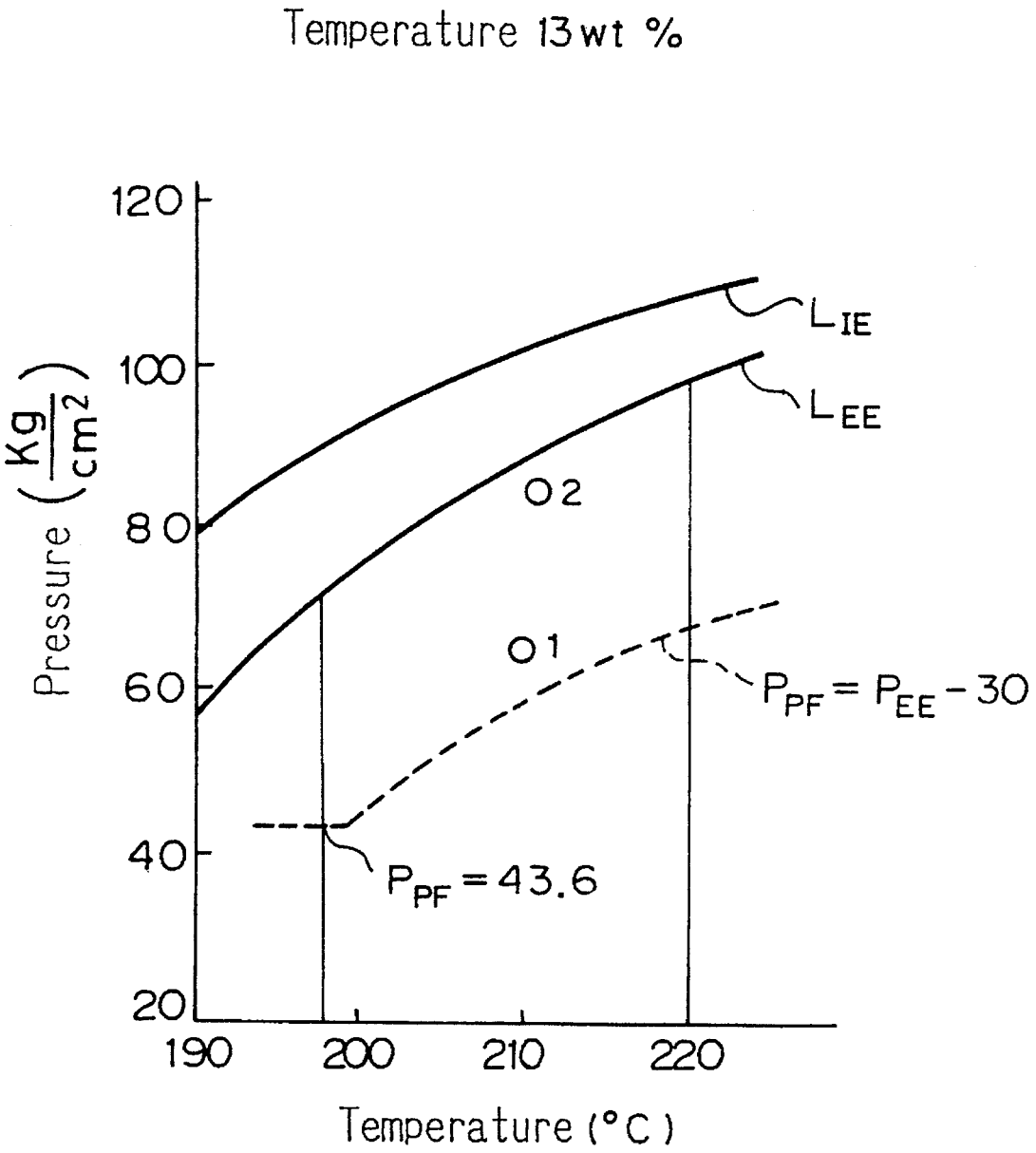
FIG. 3 is a graph of an extinction initiation line, an extinction termination line and an appropriate range of a temperature and a pressure of a solution in a pressure let-down chamber, determined with respect to polymer concentration of 13 wt %, in which conditions of examples are plotted by a dot.

The temperature and pressure in the pressure let-down chamber are plotted in the phase diagram of FIG. 3. Furthermore, the MFR and concentration of the polymer just before the extrusion were controlled so that the requirement represented by the following formula was satisfied (the examples are plotted in FIG. 4):

$$0.15 - 0.014\,(Tpf - 198) \leqq \frac{MFR}{C} \leqq 1.74 - 0.029\,(Tpf - 198)$$

The main manufacturing conditions and the physical properties of the obtained fibers are shown in Table 1. The fibers obtained in the examples had an appearance where fibrils were gathered, and when observed under a microscope, it was found that the fibers had a three-dimensional plexifilamentary structure. In the fibers obtained in the examples, the microwave birefringence was at least 0.07 and the long-period scattering intensity ratio was 10 or more, and as a result, each fiber had a low elongation under heating and a low thermal shrinkage and had an superior dimensional stability under heating. In the fiber obtained in Example 1, the highest temperature capable of maintaining a dynamic elastic modulus of $5.0\times10^9$ dyne/cm$^2$ was 138° C.

The tensile strength and elongation of the fiber obtained in Example 1 were 4.9 g/d and 60%, respectively, and the tensile strength and elongation of the fiber obtained in Example 2 were 4.2 g/d and 65%, respectively. It was found that the fibers obtained in the examples had a satisfactory strength and elongation. In Example 1, the spinning speed was 10400 m/min as determined from the extrusion quantity, extrusion time and fiber fineness. In the fiber obtained in Example 1, the orientation angle by the X-ray diffractometry was 26.8°, the half value width of the diffraction peak from the 110 plane was 1.54°, the long period was 118 Å, the apparent density was 0.904 g/cm$^3$, and the specific surface area was 12.4 m$^2$/g.

Although the microwave birefringence of the fiber is high, i.e., 0.103 and the elongation under heating is low in Example 2, the long period scattering intensity ratio is relatively low and the thermal shrinkage is relatively high.

TABLE 1

| | Solution | | | | | |
|---|---|---|---|---|---|---|
| | Final Adjustment | | Just Before Passing Through Pressure Let-down Chamber | | Pressure Let-down Chamber (Solution just before extrusion) | |
| Example | Temperature (°C.) | Pressure (kg/cm$^2$G) | Temperature (°C.) | Pressure (kg/cm$^2$G) | Temperature (°C.) | Pressure (kg/cm$^2$G) |
| 1 | 215 | 260–300 | 215 | 115 | 210 | 65 |
| 2 | 213 | 260–300 | 213 | 123 | 211 | 82 |

| | Physical Properties of Fiber | | | | | | |
|---|---|---|---|---|---|---|---|
| | Fineness | | Microwave | Long-Period Scattering | Elongation (%) Under Heating | | Thermal Shrinkage (%) (145° C. × |
| Example | (d) | MFR | Birefringence | Intensity Ratio | 100° C. | 130° C. | 20 minutes) |
| 1 | 118 | 6.1 | 0.117 | 52 | 2.1 | 3.0 | 4.1 |
| 2 | 96 | 5.7 | 0.103 | 13 | 3.8 | 6.3 | 10.2 |

EXAMPLES 3 TO 5 AND COMPARATIVE EXAMLE 1

Flush spinning was carried out in the same manner as described in Example 1 or 2 so that the amounts charged of i-pp and R-11 were changed to 55.0 g and 555 g, respectively, and the polymer concentration was adjusted to 9 wt %. Various types of i-pp were used. The hole diameter of the pressure let-down orifice and the hole diameter of the spinneret were appropriately selected (the size of the outer circular groove was in proportion to the hole diameter and the depth was 3 mm.) The phase diagram changed in some cases according to the polymer used, but the difference was not large.

As in Examples 1 and 2, the solution temperature and pressure and the pressure let-down chamber temperature and pressure were selected so that the microwave birefringence of the spun fiber was 0.07 or more and the long-period scattering intensity ratio was 10 or more, and the relation among the MFR and concentration of the polymer just before the extrusion and the solution temperature just before the extrusion was controlled within the appropriate range (the data in the examples are plotted in FIG. 4). The obtained results as well as the main conditions are shown in Table 2. In the examples, the microwave birefringence was 0.07 or more and the long-period scattering intensity ratio was 10 or more, and accordingly, the elongation under heating and the thermal shrinkage were low. In Example 3, the spinning speed was 12800 m/min as determined from the extrusion quantity, extrusion time and fineness. In the fiber obtained in Example 3, the orientation angle by the X-ray diffractometry was 27.1°, the half value width of the diffraction peak from the 110 plane was 1.92°, the long period was 111 Å, the apparent density was 0.902 g/cm$^3$, and the specific surface area was 5.6 m$^2$/g.

In Comparative Example 1, the temperature and pressure of the pressure let-down chamber were outside the appropriate ranges. In the obtained fiber, the microwave birefringence was lower than 0.07 and the long-period scattering intensity ratio was very low. Accordingly, both the elongation under heating and the thermal shrinkage were high. The highest temperature capable of maintaining a dynamic elastic modulus of $5.0\times10^9$ dyne/cm$^2$ was 53° C.

TABLE 2

| | Polymer [MFR] | Pressure Reduction Orifice Diameter (mm)/ Spinneret Hole Diameter (mm) | Solution (Just Before Passing Through Pressure Let-down Chamber) Temperature (°C.) | Solution (Just Before Passing Through Pressure Let-down Chamber) Pressure (kg/cm²G) | Pressure Let-down Chamber (Solution just before extrusion) Temperature (°C.) | Pressure Let-down Chamber (Solution just before extrusion) Pressure (kg/cm²G) |
|---|---|---|---|---|---|---|
| Example 3 | A [0.7] | 0.8/0.75 | 217 | 110 | 208 | 83 |
| Example 4 | B [0.9] | 0.6/0.5 | 217 | 112 | 200 | 75 |
| Example 5 | C [1.0] | 0.65/0.5 | 214 | 110 | 215 | 80 |
| Comparative Example 1 | A [0.7] | 0.9/0.75 | 217 | 125 | 184 | 100 |

| | Physical Properties of Fiber | | | | | | |
|---|---|---|---|---|---|---|---|
| | Fineness (d) | MFR | Microwave Birefringence | Long-Period Scattering Intensity Ratio | Elongation (%) Under Heating 100° C. | Elongation (%) Under Heating 130° C. | Thermal Shrinkage (%) (145° C. × 20 minutes) |
| Example 3 | 106 | 11.6 | 0.102 | 37 | 2.7 | 4.3 | 6.2 |
| Example 4 | 59 | 5.6 | 0.108 | 44 | 2.4 | 3.7 | 4.8 |
| Example 5 | 57 | 9.9 | 0.103 | 29 | 2.9 | 4.6 | 6.6 |
| Comparative Example 1 | 99 | 12.0 | 0.065 | 3 or less | 8.5 | 16.6 | 17.5 |

A: Chisso Polypro K1011
B: Chisso polypro trial product grade × A2126
C: Chisso Polypro trial product grade × S0429
Temperature and Pressure at Final Adjustment are 215° C. and 280–300 kg/cm²G

EXAMPLE 6

Flush spinning was carried out in the same manner as described in Examples 1 and 2 by using the same apparatus as described in Examples 1 and 2, except that the amounts charged of i-pp and R-11 were changed to 91.5 g and 519 g, respectively, and the polymer concentration was adjusted to 15 wt %.

The solution temperature and pressure at the time of preparing the solution were 215° C. and 260 kg/cm²G, the solution temperature and pressure at the time of extruding the solution were 215° C. and 123 kg/cm²G, and the solution temperature and pressure in the pressure let-down chamber were 210° C. and 82 kg/cm²G.

The configuration of the spun fiber was good and fibrils were highly developed, and the microwave birefringence was 0.109 and the long-period scattering intensity ratio was 26. The elongation under heating was 2.5% at 100° C., and the thermal shrinkage was 7.0% after standing at 145° C. for 20 minutes. Furthermore, MFR was 7.5. The temperature and MFR/C in the pressure let-down chamber are plotted in FIG. 4.

EXMAPLES 7 AND 8 AND COMPARATIVE EXAMPLE 2

Flush spinning was carried out in the same manner as described in Example 1 or 2 except that the amounts charged of i-pp and R-11 were changed to 67.1 g and 543 g, respectively, and the polymer concentration was adjusted to 11 wt %. Pressure reduction orifices having a hole diameter of 0.5 mm and a length of 5 mm were used in Example 8 and Comparative Example 2. In Comparative Example 2, a spinneret having a nozzle hole diameter of 0.5 mm but having no circular groove around the nozzle hole was used. Other conditions were the same as in the apparatus used in Examples 1 and 2.

The solution temperature and pressure conditions, the temperature and pressure conditions in the pressure let-down chamber and the physical properties of the obtained fibers are shown in Table 3. In Examples 7 and 8, since spinning was carried out under appropriate conditions, fibers having the microwave birefringence and long-period scattering intensity ratio included within the ranges specified in the present invention were obtained, and these fibers had a low elongation under heating and a low thermal shrinkage and had an superior dimensional stability. In the fiber obtained in Example 7, the strength was 4.7 g/d, the elongation was 61%, the orientation angle by the X-ray diffractometry was 23.7°, the half value width of the diffraction peak from the 110 plane was 1.56°, the long period was 113 Å, the apparent density was 0.903 g/mc³, and the specific surface area was 12.5 m²/g. In Comparative Example 2, since the pressure in the pressure let-down chamber was deviated to the lower pressure side from the appropriate range, both of the microwave birefringence and long-period scattering intensity ratio were outside the ranges specified in the present invention. The configuration of the obtained fiber was bad and the fiber was brittle, and the elongation under heating was high though the thermal shrinkage was low.

The temperature in the pressure let-down chamber and MFR/C in Examples 7 and 8 are plotted in FIG. 4.

TABLE 3

| | Solution (Just Before Passing Through Pressure Let-down Chamber | | Pressure Let-down Chamber (Solution just before extrusion) | |
|---|---|---|---|---|
| | Temperature (°C.) | Pressure (kg/cm²G) | Temperature (°C.) | Pressure (kg/cm²G) |
| Example 7 | 215 | 113 | 206 | 60 |
| Example 8 | 215 | 160 | 210 | 65 |
| Comparative Example 2 | 213 | 150 | 207 | 44 |

| | Physical Properties of Fiber | | | | | | |
|---|---|---|---|---|---|---|---|
| | Fineness | | Microwave | Long-Period Scattering | Elongation (%) Under Heating | | Thermal Shrinkage (%) (145° C. × |
| | (d) | MFR | Birefringence | Intensity Ratio | 100° C. | 130° C. | 20 minutes) |
| Example 7 | 103 | 7.4 | 0.112 | 49 | 2.2 | 3.7 | 4.6 |
| Example 8 | 78 | 7.6 | 0.111 | 36 | 2.5 | 4.0 | 6.2 |
| Comparative Example 2 | 168 | 4.4 | 0.040 | 9 | 16 | — | 3.3 |

EXAMPLES 9 AND 10, COMPARATIVE EXAMPLES 3 AND 4

A autoclave of 534 cm³ was charged with 67.1 g of i-pp having MFR of 0.7 (Chisso Polypro K1011, Chisso K.K.), 0.336 g (0.50 PHR of i-pp) of hydroxi-di (tertiary butylbenzoic acid) aluminum (hereinafter referred to as "Al-PTBBA") and 543 g of R-11 (polymer concentration: 11 wt %). The mixture of the i-pp, the A1-PTBBA and the R-11 was heated at about 90° to 110° C. while the mixture was stirred by a propeller type stirrer to dissolve the i-pp in a solution.

The solution was further heated and the solution pressure elevated to 250 kg/cm²G to 300 kg/cm²G. The polymer was already completely dissolved at this point. Since the pressure of the solution increased with the increase of the temperature of the solution and tended to exceed 300 kg/cm²G, the solution was discharged through a discharge nozzle provided at the bottom of the autoclave to maintain the pressure at a constant pressure below 300 kg/cm²G (the withstanding pressure of the autoclave). Upon the arrival of the temperature of the solution at a predetermined temperature (heating duration of about 55 min to 75 min), the solution was discharged again to adjust the pressure to a pressure lower than a predetermined pressure by 3 kg/cm²G to 5 kg/cm²G, the temperature of the solution was adjusted again to the predetermined pressure, the stirrer was stopped, a valve provided at the top of the autoclave was opened to pressurize the autoclave at a predetermined pressure by introducing nitrogen gas into the autoclave, the discharge valve at the bottom of the autoclave was opened quickly to deliver the solution through a pressure reduction orifice having a diameter of 0.65 mm and a length of 5 mm to a pressure let-down chamber having a diameter of 8 mm and a length of 80 mm length, and then the solution was discharged into the atmosphere through a spinneret of 60° in angle of introduction from the pressure let-down chamber to the spinning hole, 0.5 mm in spinning hole diameter and 0.5 mm in spinning hole length, having a circular groove of 3.0 mm in diameter at the bottom, and 3.0 mm in depth expanding toward the front around the spinning hole. A fiber thus spun was made to strike against a copper plate disposed at a distance of about 20 mm from the spinneret at an inclination of about 45°, and then the spread fiber was received by a net of 10 mesh.

In this Example, the spinning condition was adjusted such that the microwave birefringence became 0.07 or more and the long period scattering intensity ratio became 5 or more. Namely the solution temperature and pressure just before passing through the pressure let-down chamber were adjusted to 215° C. and 118 kg/cm²G, which were over the extinction termination line. The conditions of the pressure let-down chamber were a temperature of 215° C. and a pressure of 79 kg/cm²G. These conditions of temperature and pressure are in a region of conditions satisfying the temperature of 198° C. to 220° C., the pressure of the extinction termination point or less, the extinction termination point minus 30 kg/cm²G or more, and the critical pressure of 43.6 kg/cm²G or more.

The three-dimensional plexifilamentary fibers thus obtained had a microwave birefringence of 0.091, an additive content of 0.41% determined through the quantitative analysis of aluminum (the plasma spectrochemical analysis of molten fiber), a number of free fibrils of 311, a width of 26 mm, a fineness of 68 d, a MFR of 7.5, a long-period scattering intensity of 11 determined from an X-ray small angle scattering pattern, an elongation under heating of 5.2% at 100° C. and 9.2% at 130° C., a thermal shrinkage of 3.3% (145° C.×20 min), an angle of orientation of 24.4° determined by X-ray diffraction, a half-value width of the peak of refraction from the crystal face 110 of 1.94° and an apparent density of 0.906 g/cm³ (Example 9).

The phase diagram of this system was examined prior to spinning. The extinction termination line for the solution containing Al-PTBBA was higher than that for a solution not containing Al-PTBBA by about 7 kg/cm², which was not a large difference. Since the quantity of transmitted light is remarkably reduced, it was considered that Al-PTBBA was not completely dissolved.

Another solution containing 1.68 g of Al-PTBBA (2.5 PHR of i-pp) was extruded through the spinneret for spinning. The temperature and pressure of the pressure let-down chamber were 215° C. and 81 kg/cm²G, respectively. A three-dimensional plexifilamentary spread fiber obtained had a good configuration. The Al-PTBBA content of the fiber determined through the quantitative analysis of aluminum was 1.83%. The microwave birefringence was 0.096 and the long-period scattering strength ratio was 6. The number of free fibrils was 507. The width and fineness of the fiber were 29 mm and 64 d. The elongation under heating of the fiber was 3.9% at 100° C. and 6.1% at 130° C., the thermal shrinkage was 5.7%, a maximum temperature under which the fiber maintained a dynamic elasticity of $5.0\times10^9$ dyne/cm$^2$ was 100° (Example 10).

Since a fiber spun from a solution having a high polymer concentration is less subject to longitudinal split (split along the axis of the fiber), a fiber was spun from a system having a polymer content of 13 wt % (i-pp: 79.3 g R-11:531 g, Al-PTBBA: 14.3 g (18 PHR of i-pp)). The temperature and pressure of the pressure let-down chamber were 215° C. and 83 kg/cm$^2$G, respectively. Notwithstanding the high polymer concentration as compared with those of Examples 1 and 2, the fiber thus obtained had many axial splits (Comparative Example 3).

A fiber was spun from the same solution as the solution of Examples 9 and 10 except the omission of A1-PTBBA and spread under the same conditions as those for Examples 9 and 10. The fiber thus obtained had comparatively satisfactory characteristics such as the microwave birefringence of 0.100, the long-period scatter intensity ratio of 4.7 the elongation under heating of 4.6% at 100° C. and 7.1% at 130° C. and the thermal shrinkage of 4.2%. However, the number of free fibril was small, i.e., 132/54 d, the fiber had many splits, holes ad unsatisfactory spreading property (Comparative Example 4).

EXAMPLE 11

A trichlorofluoromethane solution of 10% i-pp containing 1.0 PHR of i-pp of 1,3,2,4-diparamethyl-dibenzylidene sorbitol (Gelol, Shin Nippon Rika K.K.) (hereinafter abbreviated to "PMDBS") as an additive was prepared in the autoclave with an viewing window as shown in FIG. 1. The MFR of the i-pp (Chisso Polypro K10111) was 0.7. The phase diagram of the solution was examined. The extinction initiation line and the extinction termination line of the solution were shifted to the low-temperature and high-pressure side respectively by 15 kg/cm$^2$G to 25 kg/cm$^2$G and 10 kg/cm$^2$G to 20 kg/cm$^2$G relative to those of a solution not containing PMDBS.

On the basis the phase diagram, a solution of the same composition containing 61.0 g i-pp, 0.610 g PMDBS and 549 g trichlorofluoromethane was subjected to flash spinning and the fiber obtained by flash spinning was spread by using the same apparatus as that used in Example 1. The solution temperature and pressure just before passing through the pressure let-down chamber were 213° C. and 115 kg/cm$^2$G, respectively. The temperature and pressure of the pressure let-down chamber were 213° C. and 78 kg/cm$^2$G, respectively.

Spread fiber having a satisfactory morphology was obtained. The microwave birefringence was 0.103. The long-period scattering intensity determined from an X-ray small angle scattering was 6.

The fineness of fiber was 67 d and 32 mm in width and had free fibrils of 391. The elongation under heating was 4.1% at 100° C. and 6.7% at 130° C., and the thermal shrinkage was 4.5%. A maximum temperature under which the fiber maintained a dynamic elasticity of $5.0\times10^9$ dyne/cm$^2$ was 116° C., the angle of orientation determined by X-ray diffraction was 21.2°, the half-value width of the peak of diffraction from the crystal face 110 was 1.94°, the long period was 115 Å, the apparent density was 0.903 g/cm$^3$, the specific surface area was 5.6 m$^2$/g and the MFR was 5.7.

EXAMPLES 12 AND 13

A solution of i-pp (Chisso Polypro K1011) of 0.7 in MFR, an additive (0.5 PHR of polymer) and R-11 was subjected to flash spinning and a fiber obtained was spread. The same apparatus as that used for producing the fiber of Examples 9 and 10 was used.

The additive was amide stearate (a lubricant) (Alflow S-10, Nippon Yushi K.K.) for Example 12, and polycapramide (a crystalline polymer) (Asahi Kasei Kogyo K.K., 96% sulfuric acid solution of 1 g/100 cc concentration, relative viscosity (25° C.): 2.5) for Example 13. The spinning conditions and the physical properties of the spread fiber are tabulated in Table 4. As shown in Table 4, the spread fiber containing the additive and having the superior microwave birefringence and the superior long period scattering intensity was obtained, and the thus obtained fiber had an excellent spreading property and dimensional stability under heating. The additive content was determined through infrared absorption spectrum analysis.

TABLE 4

| Example | Polymer concentration | Solution (just before extrusion) Temp. (°C.) | Solution (just before extrusion) Pre. (kg/cm$^2$G) | Pressure let-down chamber (solution just before extrusion) Temp. (°C.) | Pressure let-down chamber (solution just before extrusion) Pre. (kg/cm$^2$G) |
|---|---|---|---|---|---|
| 12 | 11 | 215 | 117 | 215 | 76 |
| 13 | 9 | 215 | 115 | 215 | 78 |

| Example | Fineness (d) | Additive content (%) | Microwave birefringence | Long-period scattering Strength | Number of free fibrils | Width (mm) | Elongation under heating (%) 100° C. | Elongation under heating (%) 130° C. | Thermal shrinkage (%) 145° C. × 20 min. |
|---|---|---|---|---|---|---|---|---|---|
| 12 | 82 | 0.33 | 0.102 | 8 | 268 | 26 | 3.4 | 4.9 | 4.3 |
| 13 | 69 | 0.26 | 0.118 | 8 | 256 | 34 | 3.4 | 5.2 | 4.5 |

EXAMPLE 14

A polymer solution preparing and spinning apparatus was used for spinning. The polymer solution preparing and spinning apparatus comprises a sequential arrangement of a screw extruder, a solvent supply unit, a mixing unit, a pressure let-down chamber and a spinneret. Chips of i-pp of 2.2 in MFR and containing 0.5 PHR Al-PTBBA was molten and extruded by the screw extruder into the mixing unit, while a R-11 was supplied into the solvent supplying unit by a high-pressure constant-displacement pump, and the solvent and the i-pp were mixed in the mixing unit in a homogeneous solution. The solution was supplied through the pressure let-down chamber to the spinneret to discharge the solution through the spinneret in fibers so that the fibers strikes against a rotary dispersing plate having three ridges and arranged on a position apart from the spinneret, such as a rotary dispersing plate disclosed in U.S. Pat. No. 3,456,156, rotating at 1500 rpm. The fibers discharged from the spinneret are thus spread in three-dimensional plexifilamentary fibers. The three-dimensional plexifilamentary fibers were dispersed in direction substantially perpendicular to the direction of movement of the net conveyor moving at a running speed of 7.2 m/min and, at the same time, the fibers were charged by corona discharge to accumulate the fibers in a sheet. The sheet of the fibers was compressed lightly between a metal roll and a rubber roll just after leaving the net conveyor to form a contact-bonded nonwoven fabric. The contact-bonded nonwoven fabric was wound up in a roll.

The pressure reduction orifice of the pressure let-down chamber has a diameter of 0.5 mm and a length of 5 mm. The volume of the pressure let-down chamber was approximately 3 $cm^3$. The spinneret was 60° in angle of introduction from the pressure let-down chamber to the spinning hole, 0.7 mm in spinning hole diameter and 0.7 mm in spinning hole length, and had a circular groove formed coaxially around the spinning hole, and having a diameter or 4.3 mm and a depth of 3.6 mm. The solution extruding rate was 1460 g/min, the polymer concentration was 10.4%, the temperature and pressure of the solution were 210° C. and 263 $kg/cm^2G$, respectively, in the mixing unit, and 206° C. and 60 $kg/cm^2G$, respectively, in the pressure let-down chamber. The retention time of the solution in the spinning apparatus was about minutes.

The spread fiber extracted from the contact-bonded nonwoven fabric was a plexifilamentary fiber of 166 d in fineness, 578 in number of free fibrils and 45 mm in width. The Al-PTBBA content of the plexifilamentary fiber determined through the quantitative analysis (plasma emission spectrochemical analysis) of aluminum was 0.42%. The MFR was 5.6. The microwave birefringence was 0.102, and the long period scattering intensity ratio was 14. The long period was 90 Å. The elongation under heating was 3.5% at 100° C., and 5.7% at 130° C. The thermal shrinkage was 3.8%. The fiber as spun had a strength of 1.1 g/d and an elongation of 30%. The fiber having eight twists per centimeter had a strength of 3.1 g/d and an elongation of 88%. The X-ray orientation angle was 30°.

The contact-bonded nonwoven fabric was subjected to heat-bonding to obtain a heat-bonded nonwoven fabric. In a first pressing pass for heat-bonding, the contact-bonded nonwoven fabric was compressed between the metal roll and the rubber roll with one side thereof in contact with the metal roll. In the first pressing pass, the surface temperature of the metal roll was 146° C., the nipping pressure was 10 kg/cm and the surface speed of the metal roll was 10 m/min. In a second pressing pass for heat-bonding, the contact-bonded nonwoven fabric was compressed between the metal roll and the rubber roll with the other surface thereof in contact with the metal roll. In the second pressing pass, the surface temperature of the metal roll was 148° C. and the nipping pressure was 15 kg/cm.

A plexifilamentary PP nonwoven fabric thus obtained was a highly orientated sheet having a microwave birefringence of 0.091 determined from the difference between the microwave refractive index with respect to the lengthwise direction in a section and the microwave refractive index with respect to the direction of thickness in the section. The difference between the maximum and minimum microwave refractive indexes with respect to each direction in a plane was 0.007, and the surface orientation was highly uniform. Elongations under heating of samples of 0.5 mm in width were 8.4% in the lengthwise direction and 6.6% in the transverse direction at 100° C., and 14.5% in the longitudinal direction and 12.0% in the transverse direction at 130° C., the lengthwise thermal shrinkage was 2.1% and the transverse thermal shrinkage was 1.2%.

| Other physical properties: | |
|---|---|
| Weight per unit area: | 48.2 $g/m^2$ |
| Thickness: | 0.16 mm |
| Tensile strength: | |
| Lengthwise: | 7.9 kg/3 cm, |
| Transverse: | 8.9 kg/3 cm |
| Tensile strength ratio: | 0.89 |
| Elongation: | |
| Lengthwise: | 23%, |
| Transverse: | 28% |
| Elemendorf tear strength: | |
| Lengthwise: | 0.14 kg, |
| Transverse: | 0.17 kg |
| Water resistance: | 2200 mm aq. |
| Gurley permeability: | 210 sec/100 cc |
| Whiteness: | 93% |
| Opacity: | 92% |
| Laser transmissivity: | 0.36% |
| Uniformity: | |
| Variation ratio of laser beam transmission intensity: | 85 |

Figure 5A:
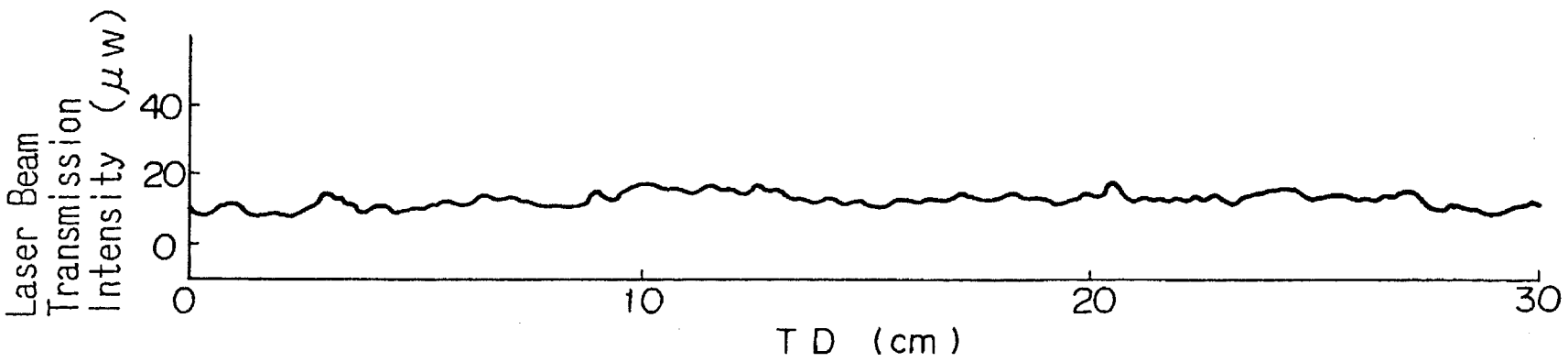
FIG. 5 a graph of a Laser beam transmission intensity in a transverse direction of a nonwoven fabric, FIG. 5(*a*) is a graph of an example according to the present invention and FIG. 5(*b*) is a graph of a comparative example.
Figure 5B:
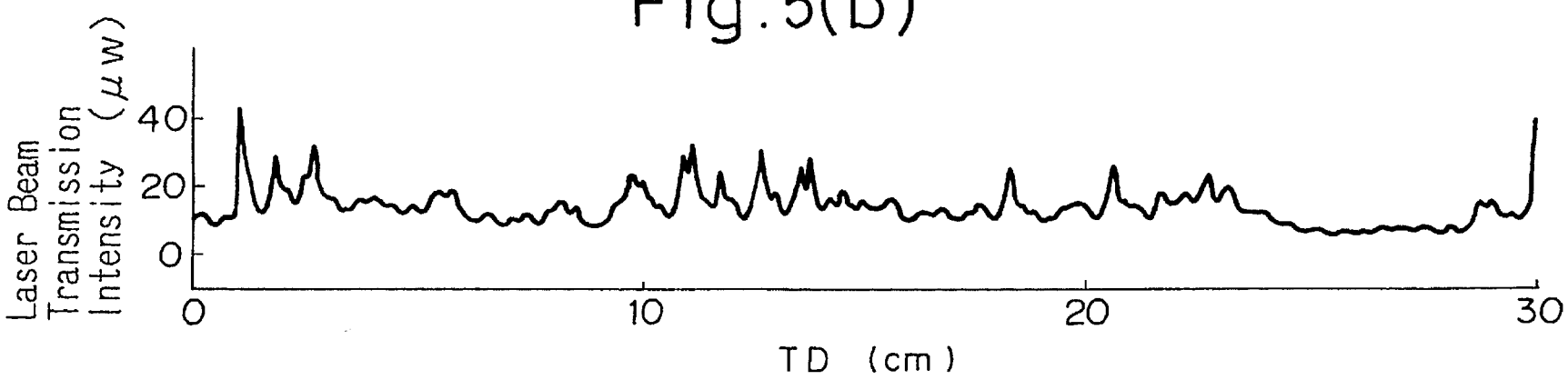

Variance of laser beam transmission intensity in the transverse direction (TD) is shown in FIG. 5(*a*). The variation of laser beam transmission intensity of the nonwoven fabric obtained by spinning, web forming and heat-bonding in the same manner as in Example from a material which did not include the spreading agent is shown in FIG. 5(*b*). The variation is 191%, and since the spreadability of fiber is inferior, microscopic irregularities were remarkably generated.

EXAMPLES 15 AND 16

Chips of i-pp of 2.8 in MFR containing 0.5 PHR 1,3,2,4-diparamethyl-dibenzylidene sorbitol as an additive were used as polymer chips. Contact-bonded nonwoven fabrics were obtained through spinning, spreading, dispersing and piling processes on the same apparatus as that used for Example 14.

In the spinning process, the solution extruding rate was 1480 g/min, the polymer concentration was 10.8%, the temperature and pressure of the solution were 211° C. and 240 $kg/cm^2G$, respectively, in the mixing unit, and 209° C. and 70 $kg/cm^2G$, respectively, in the pressure let-down chamber.

The contact-bonded nonwoven fabrics were subjected respectively to two different heat-bonding processes to obtain heat-bonded nonwoven fabrics having stable surfaces. Conditions of the heat-bonding processes and the physical properties of the heat-bonded nonwoven fabrics are tabulated in Table 5. The 1,3,2,4-diparamethyl-dibenzylidene sorbitol content of the heat-bonded nonwoven fabrics determined by infrared absorption spectrum analysis was 0.47%. The microwave birefringence in a longitudinal section was 0.06 or more, the surface orientation was high, the microwave birefringence in a plane was very small, which indicates that the surface orientation is highly uniform. The thermal shrinkage and the elongation under heating were small and the dimensional stability under heating was high.

Figure 6:
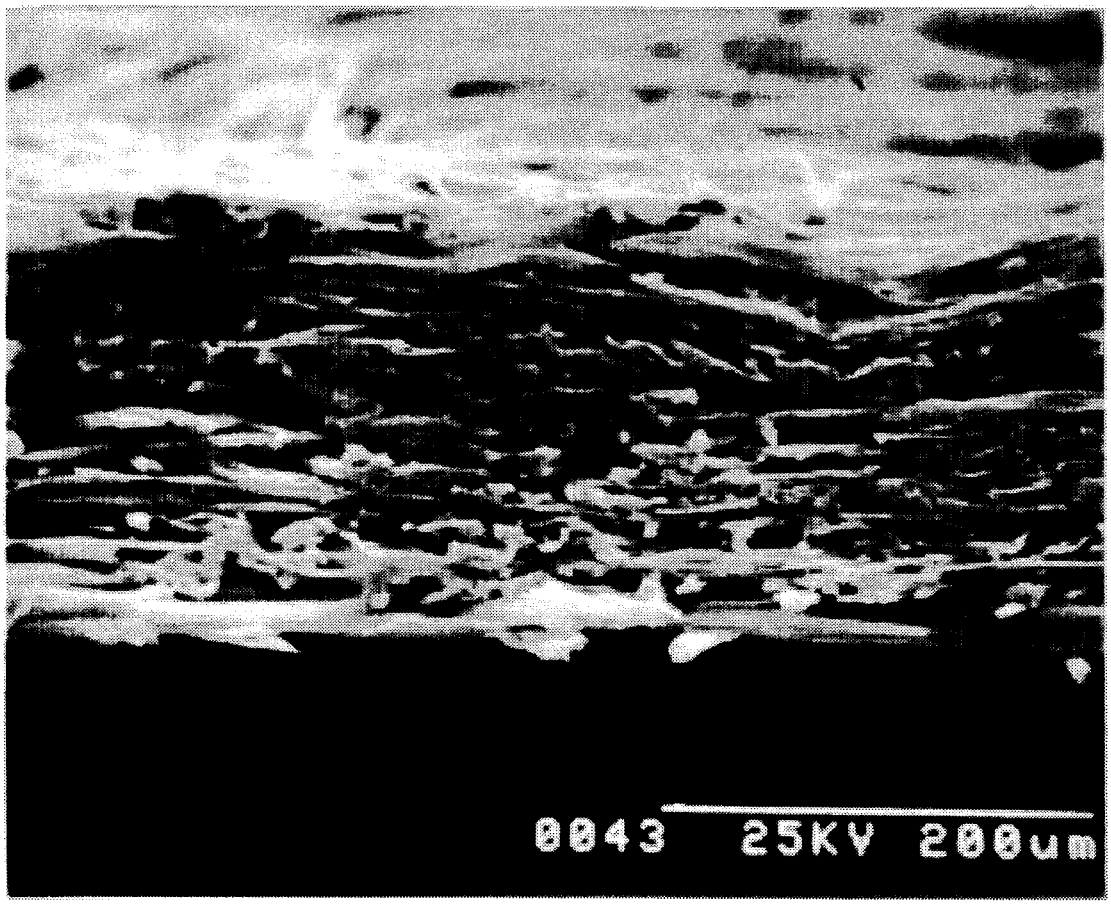
FIG. 6 is a microscopic view illustrating a cross section of an example of a nonwoven fabric according to the present invention.

The microscopic view of the cross section obtained by cutting the nonwoven fabric of Example 16 in a lengthwise direction is shown in FIG. 6.

TABLE 5

| | Condition in heat-bonding | | | | | | |
|---|---|---|---|---|---|---|---|
| | | First surface | | | Second surface | | |
| Exanple | Apparatus | Surface temperature (°C.) | Nipping pressure | Surface speed (m/min) | Surface temperature (°C.) | Nipping pressure | Surface speed (m/min) |
| 15 | Emboss | | kg/cm | | | kg/cm | |
| | Roll | 142 | 6.4 | 10 | 147 | 14.3 | 10 |
| 16 | Felt | | g/cm$^2$ | | | g/cm$^2$ | |
| | Calender | 164 | 25 | 20 | 164 | 25 | 20 |

| | Physical properties of heat-bonding nonwoven fabric | | | | | | | | | |
|---|---|---|---|---|---|---|---|---|---|---|
| Example | Thickness (mm) | Weight per unit area (g/m$^2$) | Microwave birefringence in cross section | Difference between the maximum and minimum microwave refractive indexes in a plane | Variation ratio of laser beam transmission intensity | Thermal shrinkage (%) Lengthwise/ Transverse | Elongation under heating (%) (100° C.) Lengthwise/ Transverse | Tensile strength (kg/3 cm) Lengthwise/ Transverse | Elemendorf tear strength (kg) Lengthwise/ Transverse | Gurley permeability (sec/100 cc) Lengthwise/ Transverse |
| 15 | 0.26 | 54 | 0.095 | 0.001 | 94 | 2.4/1.3 | 10.5/10.7 | 7.3/8.1 | 0.23/0.35 | 11 |
| 16 | 0.27 | 58 | 0.094 | 0.003 | 106 | 0.5/−1.2 | 9.1/9.9 | 10.2/13.7 | 0.20/0.24 | 9 |

COMPARATIVE EXAMPLE 5

Polymer chips used for forming the nonwoven fabric of Example 1 were used, and autoclave and a spinneret having a flat outer surface were used for spinning the fibers. When spinning the fibers, the pressure in the pressure let-down chamber was below the appropriate pressure. The spinning conditions were a spinning hole diameter of 0.65 mm, a diameter of the orifice of 0.7 mm, polymer concentration of 10.4%, temperature of the pressure let-down chamber of 210° C., and pressure of the pressure let-down chamber of 50 kg.cm$^2$G. Three-dimensional plexifilamentary pp fibers thus obtained had a 193 d fineness, 16 mm fiber width and 0.061 microwave birefringence. The fibers were dispersed at an angular difference of 45° to obtain a piled sheet of approximately 50 g/m$^2$. The laminated sheet was compressed with the same heat press roll as that used in heat-bonding the contact-bonded nonwoven fabric of Example 16, to obtain a heat-bonded nonwoven fabric. The heat-bonded nonwoven thus obtained had a microwave birefringence of 0.059 in a section and an elongation at 100° C. of 20% or more. The heat-bonded nonwoven fabric had an unsatisfactory dimensional stability under heating.

INDUSTRIAL APPLICABILITY

A dimensional stability under a heated environment of a pp three-dimensional plexifilamentary fiber in accordance with the present invention is high, i.e., an elongation under heating and/or a thermal shrinkage of the fiber are low. Therefore, problems of deformation appearing during a heat treatment such as heat setting, heat-bonding or the like are eliminated.

Moreover, a pp highly spread plexifilamentary fiber in accordance with the present invention has a high dimensional stability under a heated environment. That is, the elongation under heating and/or the thermal shrinkage are low. Therefore, it is possible to apply a heat treatment such as a heat-bonding of a web in which the spread fibers are piled or the like in a state where little deformation of the web exists. Further, since the spreadability is good, it is possible to manufacture a piled nonwoven fabric having a thin thickness and a good uniformity of the thickness. Further, since the strength of the fiber is high, the obtained nonwoven fabric is a nonwoven fabric having a high strength.

A pp three-dimensional plexifilamentary fiber having a high dimensional stability under a heated environment, that is a low elongation under heating and/or a low thermal shrinkage and/or a high spreadability can be obtained by a manufacturing method in accordance with the present invention.

A nonwoven fabric composed of a pp plexifilamentary fiber in accordance with the present invention has a high dimensional stability under a heated environment. That is, the elongation under heating and the thermal shrinkage is low. Therefore, it is possible to prevent problems caused by deformation of the nonwoven fabric upon applying heat-bonding, heat treatment fabrication with a heating procedure or the like, and stably treat same.

Since the uniformity of orientation in a plane of the nonwoven fabric is good, and there is no directional property, the nonwoven fabric can be easily used in all applications. Further, the uniformity of thickness and weight per unit area are superior.

A heat resistance of the nonwoven fabric in accordance with the present invention is high compared with a nonwoven fabric composed of a high-density polyethylene plexifilamentary fiber. Moreover, the nonwoven fabric in accordance with the present invention has a feature such that sound caused by deformation of the nonwoven fabric is not likely to be generated during handling and a recovery ability against deformation is superior.

Further, the nonwoven fabric in accordance with the present invention has a feature such that the nonwoven fabric has a good covering property compared with a pp spun-bond nonwoven fabric manufactured by a melt spinning method. Thus the nonwoven fabric in accordance with the present invention combines a strength of a conventional spun-bond nonwoven fabric with features of a flush spinning plexifilamentary fiber nonwoven fabric and can be used in various applications.

What is claimed is:

1. A fibrillated polypropylene three-dimensional plexifilamentary fiber, wherein said three-dimensional plexifilamentary fiber has a microwave birefringence of 0.10 or more and a long period scattering intensity ratio of 5 or more, and includes 0.1 wt % to 10 wt % of an organic spreading agent wherein said spreading agent is an organic phosphate, organic carboxylate, sorbitol derivative, aliphatic hydrocarbon, higher fatty acid, higher fatty acid alcohol, fatty acid amide, fatty acid ester, metallic soap, polyethylene resin, polyacetal resin, polybutylene terephthalate resin, hydroxy-di(tertiary butylbenzoic acid) aluminum, p-tertiary butyl sodium benzoate, sodium benzoate, 1,3,2,4-diparamethyl-dibenzylidene sorbitol, 1,3-parachlordibenzylidene-2,4-parachlorbenzylidene-D-sorbitol, 1,3,2,4-dibenzylidene sorbitol, phenyl sodium phosphate, high-density polyethylene, polycapramide, or polybutyl terephthalate.

2. A fibrillated polypropylene three-dimensional plexifilamentary fiber according to claim 1 obtained by a method comprising extruding a mixture of a uniform isotactic polypropylene solution and said organic spreading agent under high pressure through a pressure let-down chamber and a spinneret into a low-pressure low-temperature zone, wherein the pressure of the solution just before the solution passes through the pressure let-down chamber is an extinction initiation pressure or more, the temperature in the pressure let-down chamber is 198° C. or more and less than 220° C., the pressure in the pressure let-down chamber is an extinction termination pressure or less and the melting flow rate (MFR) of the isotactic polypropylene just before the extrusion satisfies the following requirement:

$$0.15 - 0.0014\,(T_{PF} - 198) \leqq \frac{MFR}{C} \leqq 1.74 - 0.029\,(T_{PF} - 198)$$

wherein $T_{PF}$ stands for the solution temperature, in the pressure let-down chamber, expressed by °C., just before the extrusion, and C stands for the concentration of the polypropylene, expressed by wt %.

3. A three-dimensional plexifilamentary fiber according to claim 1, wherein said long period scattering intensity ratio is 10 or more.

4. A three-dimensional plexifilamentary fiber according to claim 1, wherein said spreading agent is a nucleating agent, a lubricant or a crystalline resin except a base resin.

5. A three-dimensional plexifilamentary fiber according to claim 3, wherein said spreading agent is a lubricant or crystalline resin except a base resin.

6. A nonwoven fabric composed of a fibrillated polypropylene three-dimensional plexifilamentary fiber containing an organic spreading agent, wherein said nonwoven fabric has a microwave birefringence in a cross section of 0.09 or more, a difference between a lengthwise direction and a transverse direction of the microwave refractive index in a plane of 0.02 or less, and a variation ratio of laser beam transmission intensity of 150% or less, and said three-dimensional plexifilamentary fiber has a long period scattering intensity ratio of 5 or more and includes 0.1 wt % to 10 wt % of an organic spreading agent wherein said spreading agent is an organic phosphate, organic carboxylate, sorbitol derivative, aliphatic hydrocarbon, higher fatty acid, higher fatty acid alcohol, fatty acid amide, fatty acid ester, metallic soap, polyethylene resin, polyacetal resin, polybutylene terephthalate resin, hydroxy-di(tertiary butylbenzoic acid) aluminum, p-tertiary butyl sodium benzoate, sodium benzoate, 1,3,2,4-diparamethyl-dibenzylidene sorbitol, 1,3-parachlordibenzylidene-2, 4-parachlorbenzylidene-D-sorbitol, 1,3,2,4-dibenzylidene sorbitol, phenyl sodium phosphate, high-density polyethylene, polycapramide, or polybutyl terephthalate.

7. A nonwoven fabric according to claim 6, wherein said spreading agent is a nucleating agent, a lubricant or a crystalline resin except a base resin.

* * * * *